US009474397B2

(12) United States Patent
Minnette

(10) Patent No.: US 9,474,397 B2
(45) Date of Patent: Oct. 25, 2016

(54) CONTAINER CLOSURE

(71) Applicant: Berry Plastics Corporation, Evansville, IN (US)

(72) Inventor: Jeffrey C. Minnette, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 72 days.

(21) Appl. No.: 14/264,512

(22) Filed: Apr. 29, 2014

(65) Prior Publication Data

US 2014/0326735 A1 Nov. 6, 2014

Related U.S. Application Data

(60) Provisional application No. 61/819,401, filed on May 3, 2013.

(51) Int. Cl.

| | |
|---|---|
| ***B65D 6/00*** | (2006.01) |
| ***B65D 8/04*** | (2006.01) |
| ***B65D 8/18*** | (2006.01) |
| ***B65D 90/02*** | (2006.01) |
| ***A47G 19/02*** | (2006.01) |

(Continued)

(52) U.S. Cl.

CPC ..... *A47G 19/02* (2013.01); *B65D 43/0256* (2013.01); *B65D 43/0262* (2013.01); *B65D 77/2088* (2013.01); *B65D 2543/0024* (2013.01); *B65D 2543/0037* (2013.01); *B65D 2543/0074* (2013.01); *B65D 2543/00092* (2013.01); *B65D 2543/00296* (2013.01); *B65D 2543/00425* (2013.01); *B65D 2543/00537* (2013.01); *B65D 2543/00657* (2013.01); *B65D 2543/00685* (2013.01); *B65D 2543/00796* (2013.01); *B65D 2543/00814* (2013.01); *B65D 2543/00842* (2013.01); *B65D 2577/205* (2013.01)

(58) Field of Classification Search

CPC ..... B65D 41/00; B65D 41/16; B65D 51/12; B65D 51/20; B65D 51/18

USPC ..... 220/213, 620, 480, 359.1–359.3, 256.1, 220/254.1; 206/776–778; 229/125.015; 215/232; 53/476–477

See application file for complete search history.

(56) References Cited

U.S. PATENT DOCUMENTS

| | | | | |
|---|---|---|---|---|
| 2,614,727 | A | 10/1952 | Robinson | |
| 2,772,013 | A | 11/1956 | Stover | |
| 2,901,140 | A * | 8/1959 | Robinson | B65D 43/0212 215/277 |

(Continued)

FOREIGN PATENT DOCUMENTS

| | | |
|---|---|---|
| EP | 0536137 B1 | 8/1995 |

OTHER PUBLICATIONS

Office Action dated Jan. 21, 2016 for U.S. Appl. No. 13/661,704.

(Continued)

*Primary Examiner* — Nathan J Newhouse
*Assistant Examiner* — Jennifer N Zettl
(74) *Attorney, Agent, or Firm* — Barnes & Thornburg LLP

(57) ABSTRACT

A package includes a container and a closure for an opening into an interior region formed in the container. The closure is configured to mount on a brim of the container. The closure includes a sheet-support ring that surrounds the brim of the closure and a membrane sheet bonded permanently to the sheet-support ring to form an endless hermetic seal therebetween.

11 Claims, 12 Drawing Sheets

(51) Int. Cl.
*B65D 77/20* (2006.01)
*B65D 43/02* (2006.01)

(56) References Cited

U.S. PATENT DOCUMENTS 3,276,616 A * 10/1966 Lurie ..... B65D 43/0214 156/73.5
3,834,606 A 9/1974 Anderson
3,913,785 A * 10/1975 Pattershall ..... B44D 3/127 206/508
3,934,749 A 1/1976 Andrulionis
3,938,686 A * 2/1976 Milligan ..... B44D 3/12 15/257.05
3,956,550 A * 5/1976 Sutch ..... B29C 45/14336 156/242
4,044,941 A * 8/1977 Knudsen ..... B29C 65/3656 206/515
4,109,815 A * 8/1978 Collins, III ..... B67B 5/00 215/232
4,111,330 A * 9/1978 Jordan ..... B65D 43/0216 220/260
4,141,463 A 2/1979 Smith
4,171,084 A * 10/1979 Smith ..... B65D 51/145 215/232
4,192,434 A * 3/1980 Conroy ..... B65D 21/0219 229/125.13
4,209,107 A 6/1980 Crisci
4,215,797 A * 8/1980 Chen ..... B65D 43/022 220/276
4,238,047 A * 12/1980 Helms ..... B65D 43/0212 220/782
4,252,248 A 2/1981 Obrist
4,258,529 A 3/1981 Smith
4,349,119 A 9/1982 Letica
4,356,930 A * 11/1982 Roper ..... B65D 11/26 206/508
4,397,133 A 8/1983 Hume
4,418,834 A * 12/1983 Helms ..... B65D 43/0212 215/232
4,438,864 A 3/1984 Helms
4,442,971 A * 4/1984 Helms ..... B65D 15/04 220/780
4,448,345 A * 5/1984 Helms ..... B29C 65/56 215/232
4,495,749 A 1/1985 Faller
4,533,063 A 8/1985 Buchner
4,595,117 A 6/1986 Walter
4,685,273 A 8/1987 Caner
4,692,132 A 9/1987 Ikushima
4,738,374 A 4/1988 Ingemann
4,838,008 A 6/1989 Hardy
5,039,001 A 8/1991 Kinigakis
5,091,231 A 2/1992 Parkinson
5,097,107 A 3/1992 Watkins et al.
5,098,751 A 3/1992 Tamura
5,174,460 A * 12/1992 Minnette ..... B65D 41/086 215/330
5,178,297 A 1/1993 Harold
5,246,134 A 9/1993 Roth
5,248,134 A 9/1993 Ferguson
5,258,191 A 11/1993 Hayes
5,377,873 A * 1/1995 Minnette ..... B65D 47/242 222/39
5,385,255 A * 1/1995 Varano ..... B65D 43/0212 220/380
5,395,005 A * 3/1995 Yoshida ..... B29C 45/14221 220/270
5,428,209 A * 6/1995 Babu ..... B65D 81/3446 219/728
5,443,853 A * 8/1995 Hayes ..... B65D 41/3428 215/253
5,511,679 A 4/1996 Beck
5,634,567 A * 6/1997 Hekal ..... B65B 7/2878 215/232
5,647,501 A * 7/1997 Helms ..... B29C 45/14336 220/780
5,692,635 A 12/1997 Farrell
5,810,197 A 9/1998 Mazzarolo
5,911,334 A * 6/1999 Helms ..... B65D 77/2088 220/359.3
5,947,278 A 9/1999 Sawhney
5,950,861 A 9/1999 Roth
5,983,607 A 11/1999 Mihalov
6,032,823 A * 3/2000 Bacon ..... B65D 3/04 220/620
6,053,353 A * 4/2000 Helms ..... B65D 5/64 206/508
6,145,689 A 11/2000 Kobayashi
6,196,451 B1 * 3/2001 Helms ..... B29C 45/14336 220/782
6,234,386 B1 * 5/2001 Drummond ..... B29C 66/022 229/123.2
6,439,387 B1 8/2002 Bergman
6,508,375 B1 * 1/2003 Krall ..... B65D 47/122 215/232
6,523,713 B1 2/2003 Helms
6,637,176 B1 10/2003 Krall
6,673,303 B2 1/2004 White
6,749,066 B2 6/2004 Bergman
6,772,901 B2 8/2004 Witt
6,799,692 B2 10/2004 TeixeiraAlvares
6,857,561 B2 * 2/2005 Williams ..... B65D 3/22 220/359.3
6,881,286 B2 4/2005 Drummond
6,923,017 B2 8/2005 Dais
7,055,713 B2 6/2006 Rea
7,086,545 B2 8/2006 Mannion
7,134,576 B2 11/2006 Gringer
7,267,243 B2 9/2007 Steg
7,311,218 B2 12/2007 Varadarajan
7,584,866 B2 9/2009 Selina
7,694,837 B2 4/2010 Robertson
7,703,626 B2 * 4/2010 Witt ..... B29C 65/10 215/252
7,757,879 B2 7/2010 Schuetz
7,870,967 B2 1/2011 Sawyer
7,938,293 B2 5/2011 Gidumal
7,968,033 B2 6/2011 Mazzarolo
8,245,873 B2 8/2012 Steg
8,251,239 B2 8/2012 Yeung
8,770,427 B2 7/2014 Longo
8,991,632 B2 3/2015 Minnette
8,998,030 B2 4/2015 Minnette
9,032,698 B2 5/2015 Minnette
9,067,347 B2 6/2015 Naber
2003/0010787 A1 1/2003 Dalton
2003/0019878 A1 1/2003 Scarabelli
2003/0183636 A1 * 10/2003 Shih ..... B65D 43/0218 220/359.1
2004/0065698 A1 * 4/2004 Braunstein ..... B44D 3/128 222/570
2004/0159080 A1 8/2004 Stewart
2005/0145632 A1 7/2005 Cocca
2005/0167430 A1 * 8/2005 Varadarajan ..... B65D 43/0212 220/258.1
2006/0278603 A1 * 12/2006 Takashima ..... B29C 45/006 215/349
2007/0108216 A1 * 5/2007 Kurth ..... B60R 13/0206 220/789
2007/0187352 A1 8/2007 Kras
2007/0205196 A1 9/2007 Burney
2008/0110896 A1 5/2008 Westphal
2008/0264961 A1 10/2008 Sawyer
2009/0032534 A1 2/2009 Luburic
2009/0032535 A1 2/2009 Dunwoody
2009/0302040 A1 * 12/2009 Fox ..... B29C 45/16 220/359.2
2010/0059537 A1 3/2010 Stevens
2010/0096388 A1 4/2010 Kobayashi
2010/0140282 A1 * 6/2010 Steg ..... B65D 43/0212 220/780
2011/0100990 A1 5/2011 Clodfelter

(56) References Cited

U.S. PATENT DOCUMENTS

| | | | | |
|---|---|---|---|---|
| 2012/0199599 | A1* | 8/2012 | Minnette | B65D 43/0212 220/780 |
| 2012/0205375 | A1 | 8/2012 | Hudson | |
| 2012/0234835 | A1* | 9/2012 | Minnette | B65D 17/12 220/359.2 |
| 2012/0270167 | A1 | 10/2012 | Sato | |
| 2012/0305560 | A1 | 12/2012 | Minnette | |
| 2013/0008904 | A1* | 1/2013 | Minnette | B29C 65/087 220/270 |
| 2013/0032598 | A1 | 2/2013 | Triquet | |
| 2013/0047559 | A1* | 2/2013 | Minnette | B65D 43/0212 53/471 |
| 2013/0099414 | A1* | 4/2013 | Minnette | B29C 45/1642 264/255 |
| 2013/0104505 | A1* | 5/2013 | Minnette | B65B 7/2878 53/471 |
| 2013/0112690 | A1 | 5/2013 | Jongsma | |
| 2013/0153577 | A1 | 6/2013 | Su | |
| 2013/0270143 | A1 | 10/2013 | Muscato | |
| 2013/0292394 | A1* | 11/2013 | Minnette | B65D 1/40 220/609 |
| 2014/0116977 | A1* | 5/2014 | Minnette | B65D 41/0442 215/230 |
| 2014/0117025 | A1* | 5/2014 | Minnette | B65D 79/005 220/592.01 |
| 2014/0215974 | A1 | 8/2014 | Minnette | |
| 2014/0262916 | A1* | 9/2014 | Minnette | B65D 1/0215 206/524.2 |
| 2014/0326735 | A1 | 11/2014 | Minnette | |
| 2015/0203263 | A1* | 7/2015 | Minnette | B65D 77/2032 220/270 |
| 2016/0023820 | A1* | 1/2016 | Minnette | B65D 47/32 220/201 |

OTHER PUBLICATIONS

International Search Report and Written Opinion dated Dec. 22, 2015, relating to International Application No. PCT/US2015/041784.

International Search Report and Written Opinion dated Apr. 14, 2014, relating to International Application No. PCT/US2013/070273.

International Search Report dated Jun. 20, 2012, relating to International Application No. PCT/US2012/28010.

International Search Report dated May 11, 2012, relating to International Application No. PCT/US2012/023639.

International Search Report dated Sep. 28, 2012, relating to International Application No. PCT/US2012/045965.

European Search Report for Appl. No. 12745363.7 dated Jun. 20, 2014.

Office Action dated Aug. 18, 2015 for U.S. Appl. No. 13/661,704.

Office action dated Aug. 29, 2013 for U.S. Appl. No. 13/362,953.

Office action dated Feb. 27, 2014 for U.S. Appl. No. 13/362,953.

Office Action dated Jun. 9, 2014 for U.S. Appl. No. 13/544,753.

International Search Report and Written Opinion dated Sep. 4, 2014, relating to International Application No. PCT/US2014/035837.

English summary of Mexican Office Action issued in connection to Mexican Patent Application No. MX/a/2013/008849, mailed Sep. 22, 2015, 4 pages.

PCT International Search Report and Written Opinion completed by the ISA/US on Mar. 19, 2015 and issued in connection with PCT/US2015/012497.

Office Action dated Mar. 21, 2016 for U.S. Appl. No. 14/603,083.

Chinese Office Action for Chinese Application No. 201480031650.0, BP-417 || 5723-244307, 12 pages.

* cited by examiner

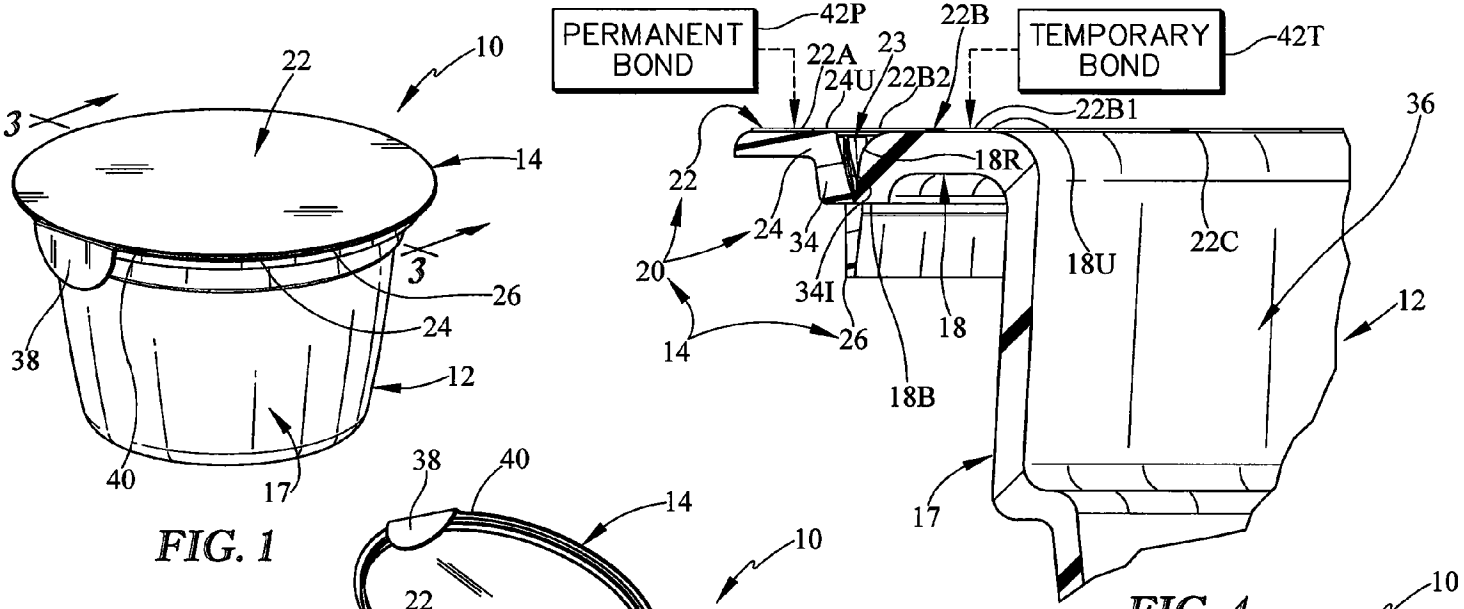
FIG. 1
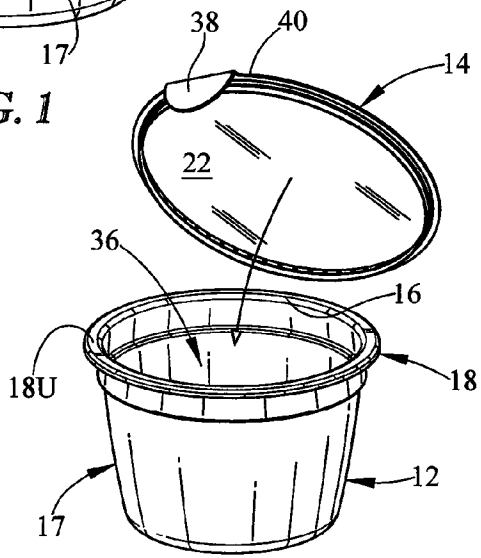
FIG. 2
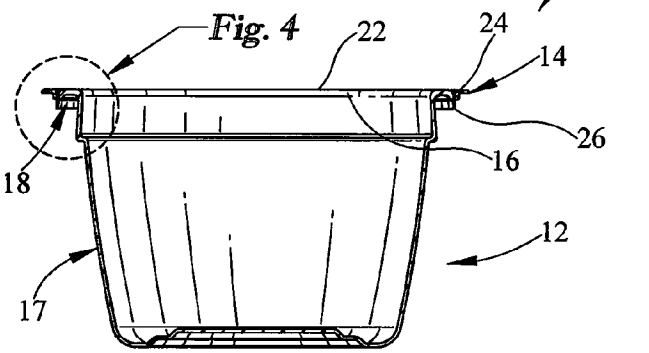
FIG. 3
FIG. 4
Fig. 4

STEP 1
STEP 2
REMOVABLE TAMPER BAND 10
12
14
16
17
18
18B
18U
20
22
22A
22B
22C
24
26
26I
34
34I
36
38
40
44
46

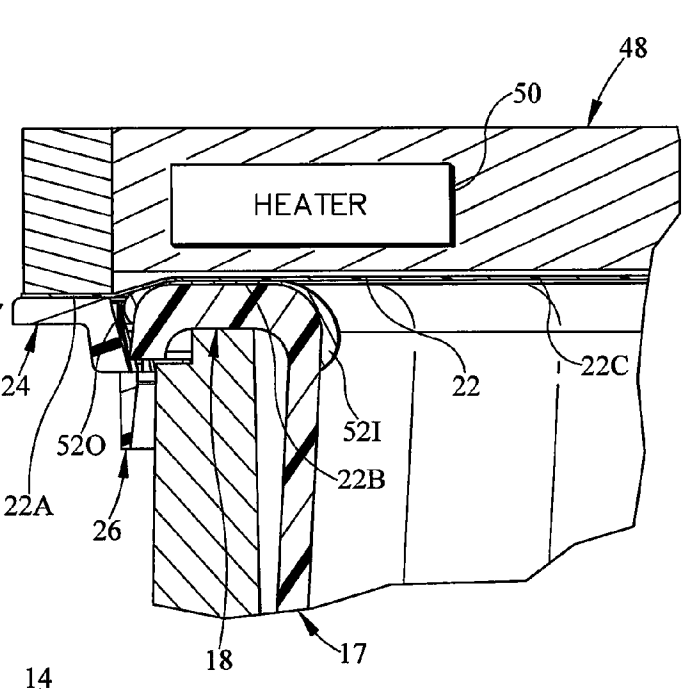
FIG. 9
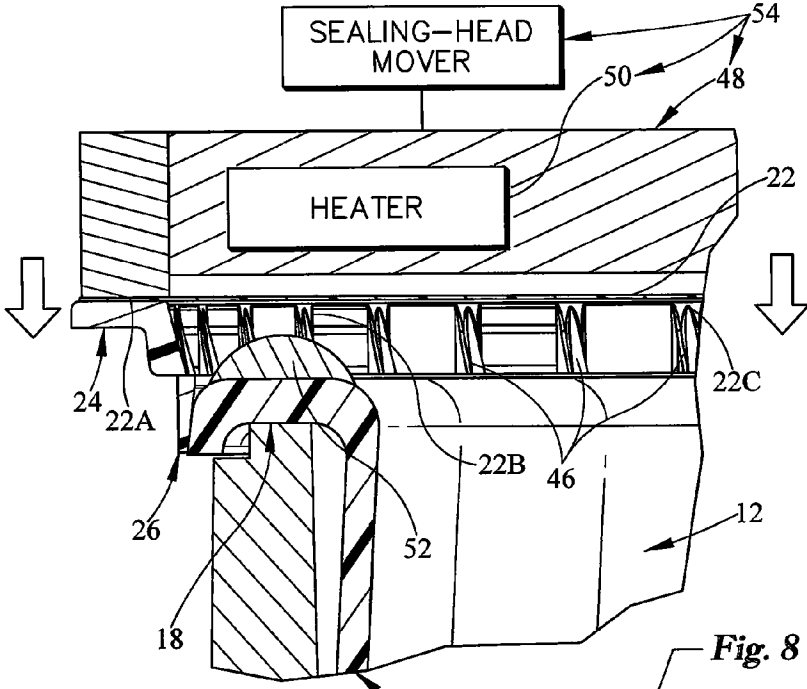
FIG. 8
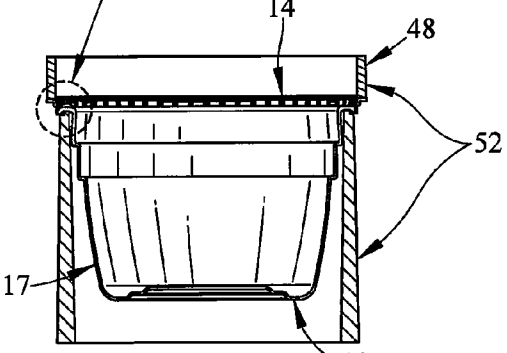
FIG. 7
Fig. 8

134
134I
146
22

114
110
122
18
140
STEP 1
114
110
122A
122B
122C
122
16
18U
18
18B
12
36
STEP 2
17
120
1241
138
12
17
138
12
17
138
122
124
138

120
44

CONTAINER CLOSURE

PRIORITY CLAIM

This application claims priority under 35 U.S.C. §119(e) to U.S. Provisional Application Ser. No. 61/819,401, filed May 3, 2013, which is expressly incorporated by reference herein.

BACKGROUND

The present disclosure relates to a package, and particularly to a package including a closure for mounting on a brim of a container. More particularly, the present disclosure relates to a reclosable closure provided with a membrane sheet that mates with a container brim when the closure is mounted on the container brim.

SUMMARY

A package in accordance with the present disclosure includes a closure adapted to mate with a brim of a container to close an opening that opens into an interior product-storage region formed in the container. In illustrative embodiments, the closure includes a sheet-support ring that is configured to surround the brim of the closure and a membrane sheet bonded permanently to the sheet-support ring to form an endless hermetic seal therebetween. The membrane sheet covers the opening into the interior product-storage region formed in a bowl included in the container when the sheet-support ring is mounted on the container brim that is appended to an upper portion of the bowl.

In illustrative embodiments, a portion of the membrane sheet is bonded temporarily to the brim at a factory after the closure is mounted on the brim of a filled container to establish an endless hermetic seal between the membrane sheet of the closure and the container brim. This endless hermetic seal remains until it is broken when the closure is removed from the container brim by a consumer for a first time to gain access to product stored in the interior product-storage region formed in the bowl. Thereafter, the consumer is free to remount the sheet-support ring of the closure on the container brim to cover the opening into the interior product-storage region formed in the bowl of the container without re-establishing an endless hermetic seal between the membrane sheet and the container brim.

In illustrative embodiments, a ring-shaped outer portion of the membrane sheet is bonded permanently to the sheet-support ring. A central portion of the membrane sheet covers the opening into the interior product-storage region formed in the container bowl when the sheet-support ring is mated with the container brim. A ring-shaped middle portion of the membrane sheet is bonded temporarily to the container brim at a container-filling factory to establish the initial endless hermetic seal between the membrane sheet and the closure. The ring-shaped middle portion surrounds the central portion and cooperates with the surrounding ring-shaped outer portion and the central portion to form the membrane sheet.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a first embodiment of a package in accordance with the present disclosure and showing that the package includes a container and a closure mounted on a brim of the container and made of a lid comprising a substantially flat membrane sheet that is shown in FIGS. 4 and 6 to be bonded permanently to an endless upwardly facing top surface of a sheet-support ring arranged to surround the container brim and bonded temporarily to an endless upwardly facing top surface of the container brim to establish an endless hermetic seal therebetween at a container-filling factory;

FIG. 2 is a perspective view of the container of FIG. 1 before the closure is mated with the container brim to close an opening that opens into an interior product-storage region formed in a bowl of the container;

FIG. 3 is a sectional view taken along line 3-3 of FIG. 1;

FIG. 4 is an enlarged partial sectional view taken from a circled region of FIG. 3 showing that the closure also includes an annular removable tamper band coupled initially by a series of frangible connectors to the sheet-support ring of the closure lid and arranged to extend downwardly from the sheet-support ring and that a sheet-support ring of the closure lid surrounds and mates with a radially outwardly facing side surface of the container brim while the annular removable tamper band of the closure is coupled to an axially extending sleeve of the sheet-support ring and arranged to engage an axially downwardly facing bottom surface of the brim and showing that a substantially flat membrane sheet of the closure lid includes a central portion arranged to cover the opening that opens into the interior product-storage region formed in the container bowl, an annular outer portion bonded permanently to an endless upwardly facing top surface of the sheet-support ring, and an annular middle portion bonded temporarily (using an adhesive, weld, or other suitable coupling means) to an endless upwardly facing top surface of the container brim to establish a hermetic seal therebetween until the closure is removed from the container brim by a consumer for a first time as suggested in FIG. 5 to access the contents of the interior product-storage region formed in the container bowl;

FIGS. 7-11 show an illustrative process for moving the closure of FIGS. 1-6 downwardly using a movable sealing head and heater to mount the closure on the brim of the container to (1) establish the temporary bond (and hermetic seal) between the substantially flat membrane sheet of the closure lid and the endless upwardly facing top surface of the container brim, (2) wipe a mound of spilled food, if present, from the container brim during closure mounting to cause some of the spilled food to move radially inwardly into the interior product-storage region formed in the container bowl and to cause some of the spilled food to move radially outwardly off the brim and away from the interior product-storage region, and (3) mating the removable tamper band and the downwardly facing surface of the container brim;

FIG. 7 is a sectional view of the container and closure of FIGS. 1-6 received in an illustrative lidding unit and showing the closure in a slightly raised position before it is mounted on the brim of the container at a factory;

FIG. 8 is an enlarged partial sectional view taken from a circled region of FIG. 7 showing the downwardly moving closure in a first engaged position on the container brim during a lid-mounting step at a factory and showing that some of the food that was discharged toward the interior product-storage region formed in the container bowl during an earlier container filling step has landed on the upwardly facing top surface of the container brim and is now located between the annular middle portion of the substantially flat membrane sheet and the endless underlying top surface of the container brim at the site of the temporary bond that will be established using heat between the membrane sheet and the container brim;

FIG. 9 shows the downwardly moving closure in a subsequent second engaged position on the container brim and showing that the mound of spilled food has been compressed between the membrane sheet of the lid and the brim of the container as a result of downward movement of the closure relative to the container brim to cause some of that food to flow radially inwardly into the interior product-storage region formed in the container bowl and some of the food to flow radially outwardly away from the container bowl;

FIG. 10 shows further downward movement of the closure relative to the container brim substantially to clear spilled food from the upwardly facing top surface of the container brim and suggests diagrammatically that a heater provided in the sealing head has been activated to heat the annular middle portion of the substantially flat membrane sheet to establish a temporary chemical bond (and hermetically sealed connection) between the annular middle portion of the membrane sheet and the endless upwardly facing top surface of the container brim and also shows diagrammatically that any minute quantity of residual spilled food left on the endless upwardly facing top surface of the container brim is gasified during exposure of the membrane sheet to heat from the heater and passed as a gas through the membrane sheet to the surroundings;

FIG. 11 is a view similar to FIG. 4 showing the closure mounted on the container brim;

FIG. 22A is an enlarged partial sectional view taken from a circled region of FIG. 20 showing that the sheet-support ring includes an axially extending sleeve, a series of circumferentially spaced-apart, radially inwardly extending, lid-retention ribs coupled to an inner surface of the axially extending sleeve, and a series of circumferentially spaced-apart, radially inwardly extending, lid-retention bands coupled to an inner surface of the axially extending sleeve, the lid-retention bands and the lid-retention ribs being configured to establish a somewhat tight interference fit between the closure lid and the container brim to retain the closure lid in a stationary position on the container brim each time a consumer mounts the closure lid shown in Step 2 of FIG. 22 once again on the brim of the container;

DETAILED DESCRIPTION

Figures 5, 5A:
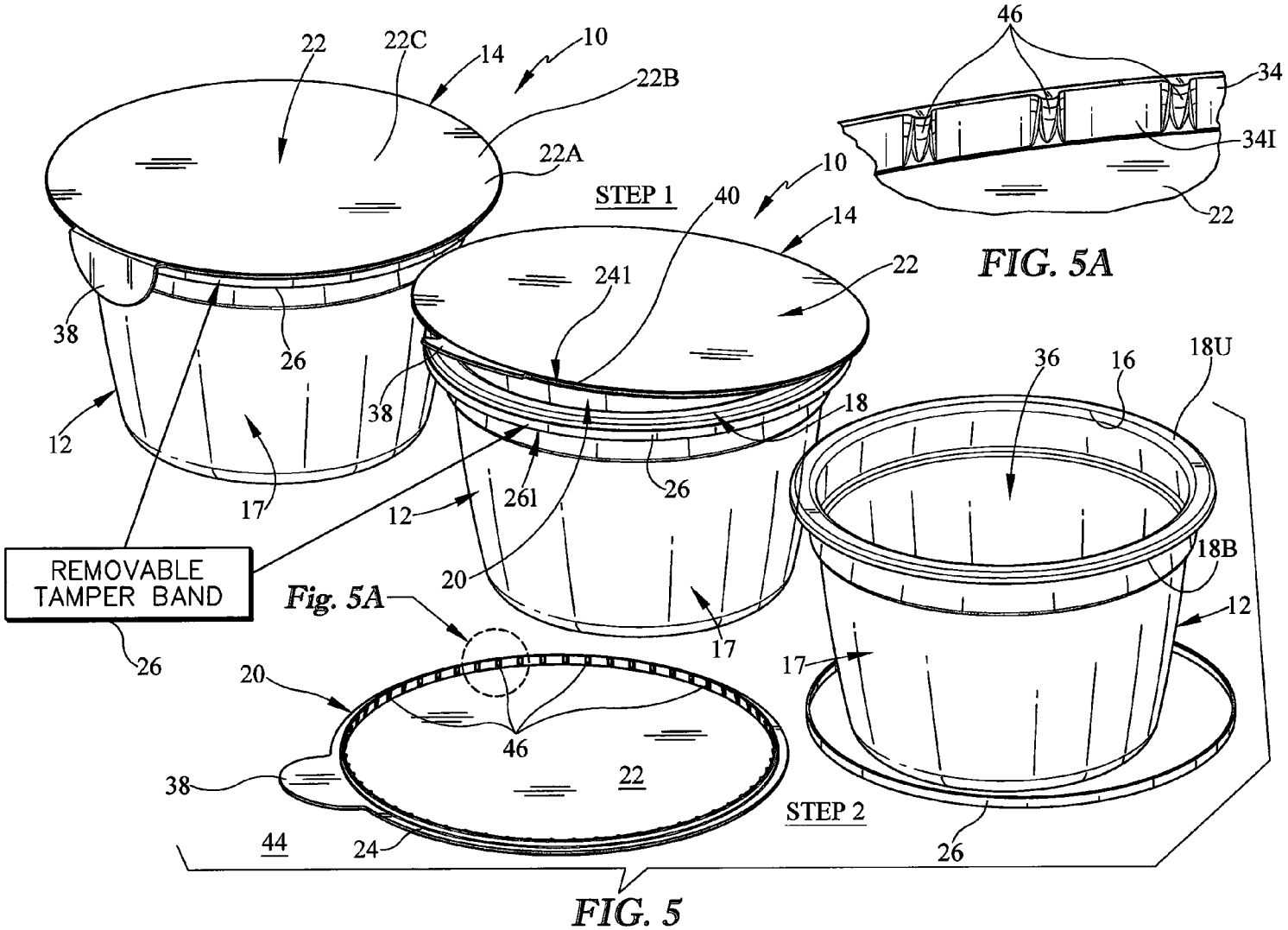
FIG. 5 shows an illustrative closure removal process in which a consumer removes the closure from the container brim for a first time and suggesting that the process includes the steps of: (1) gripping a pull tab coupled to a perimeter edge of the substantially flat membrane sheet and lifting the sheet-support ring upwardly owing to the permanent bond established between the annular outer portion of the membrane sheet and the sheet-support ring to cause breakage of nearby frangible connectors that were coupled initially to each of the sheet-support ring and the removable tamper band and to allow separation of a first arc-shaped section of the sheet-support ring from the container brim to break the temporary bond that had been established between the annular middle portion of the membrane sheet of the closure lid and the endless upwardly facing top surface of the container brim and move upwardly away from a companion first arc-shaped section of the removable tamper band and (2) completing separation of the sheet-support ring of the closure lid from the container brim to break all temporary bonds (and the hermetic seal) between the annular middle portion of the membrane sheet of the lid and the endless upwardly facing top surface of the container brim and then inverting the closure lid comprising the sheet-support ring, substantially flat membrane sheet, and pull tab while allowing the removed tamper band to fall downwardly to land on a surface underneath the container to surround the container.
FIG. 5A is an enlarged partial sectional view taken from a circled region of FIG. 5 showing that the sheet-support ring includes an axially extending sleeve and a series of circumferentially spaced-apart, radially inwardly extending, lid-retention ribs coupled to an inner surface of the axially extending sleeve and configured to establish a somewhat tight interference fit between the lid and the container brim to retain the lid in a stationary position on the container brim each time a consumer mounts the lid shown in Step 2 of FIG. 5 once again on the brim of the container.
Figures 12, 13, 14, 15:
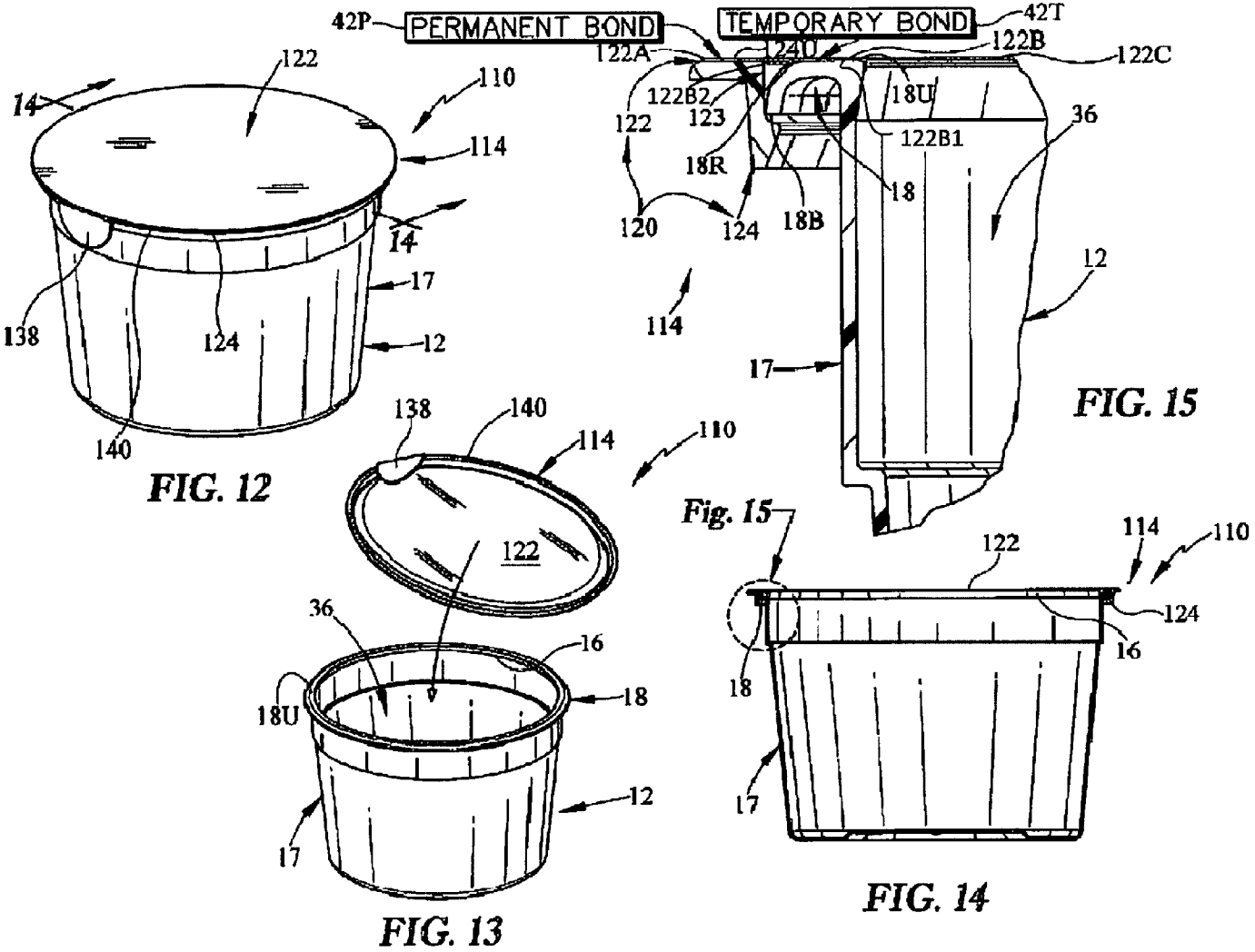
FIG. 12 is a perspective view of a second embodiment of a package in accordance with the present disclosure and showing that the package includes a container and a closure mounted on a brim of the container and made of a substantially flat membrane sheet that is shown in FIG. 15 to be bonded permanently to an endless upwardly facing surface of a sheet-support ring arranged to surround and mate with the container brim and bonded temporarily to an endless upwardly facing top surface of the container brim to establish an endless hermetic seal therebetween at a container-filling factory.
FIG. 13 is a perspective view of the container of FIG. 12 before the closure is mated with the container brim to close an opening that opens into an interior product-storage region formed in a bowl of the container.
FIG. 14 is a sectional view taken along line 14-14 of FIG. 12.
FIG. 15 is an enlarged partial sectional view taken from a circled region of FIG. 14 showing that a sheet-support ring surrounds and mates with a radially outwardly facing side surface of the container brim and engages an axially downwardly facing bottom surface of the brim and showing that a substantially flat membrane sheet includes a central portion arranged to cover the opening into the interior product-storage region formed in the container bowl, an annular outer portion bonded permanently to an endless upwardly facing top surface of the sheet-support ring, and an annular middle portion bonded temporarily (using an adhesive, weld, or other suitable coupling means) to an endless upwardly facing top surface of the container brim to establish a hermetic seal therebetween until the closure is removed from the container brim by a consumer for a first time to access the contents of the interior product-storage region formed in the container bowl.
Figures 16, 16A:
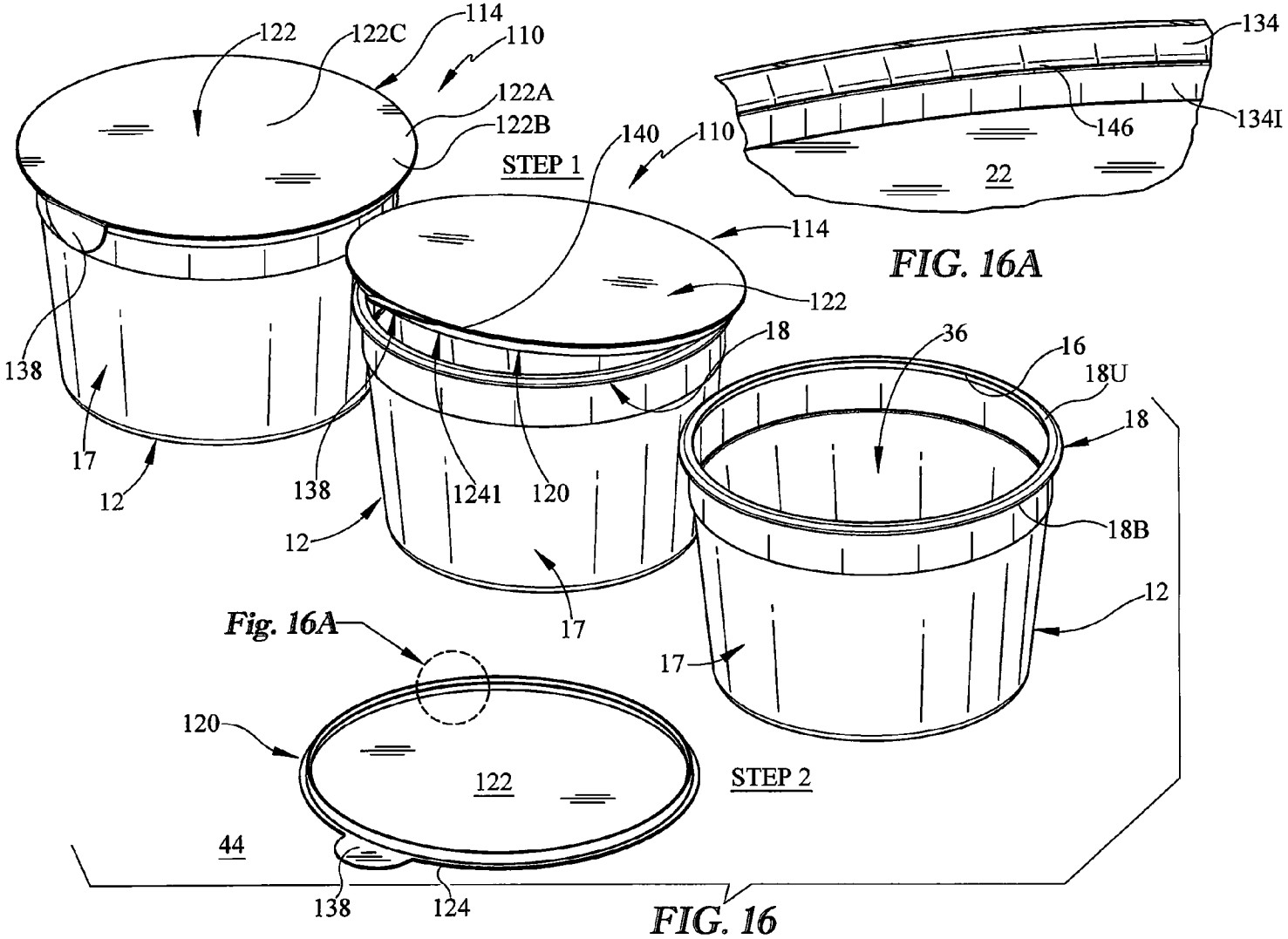
FIG. 16 shows an illustrative closure removal process in which a consumer removes the closure from the container brim for a first time and suggesting that the process includes the steps of: (1) gripping a pull tab coupled to a perimeter edge of the substantially flat membrane sheet and lifting the sheet-support ring upwardly owing to the permanent bond established between the annular outer portion of the membrane sheet and the sheet-support ring to allow separation of a first arc-shaped section of the sheet-support ring from the container brim to break the temporary bond (and hermetic seal) that had been established between the annular middle portion of the membrane sheet and the endless upwardly facing top surface of the container brim and (2) completing separation of the sheet-support ring from the container brim to break all temporary bonds between the annular middle portion of the membrane sheet and the endless upwardly facing top surface of the container brim and then inverting the closure and placing it on the surface adjacent to the container.
FIG. 16A is an enlarged partial sectional view taken from a circled region of FIG. 5 showing that the sheet-support ring includes an axially extending sleeve and a radially extending brim retainer configured to mate with the container brim of the container as shown in FIG. 15.
Figure 17:
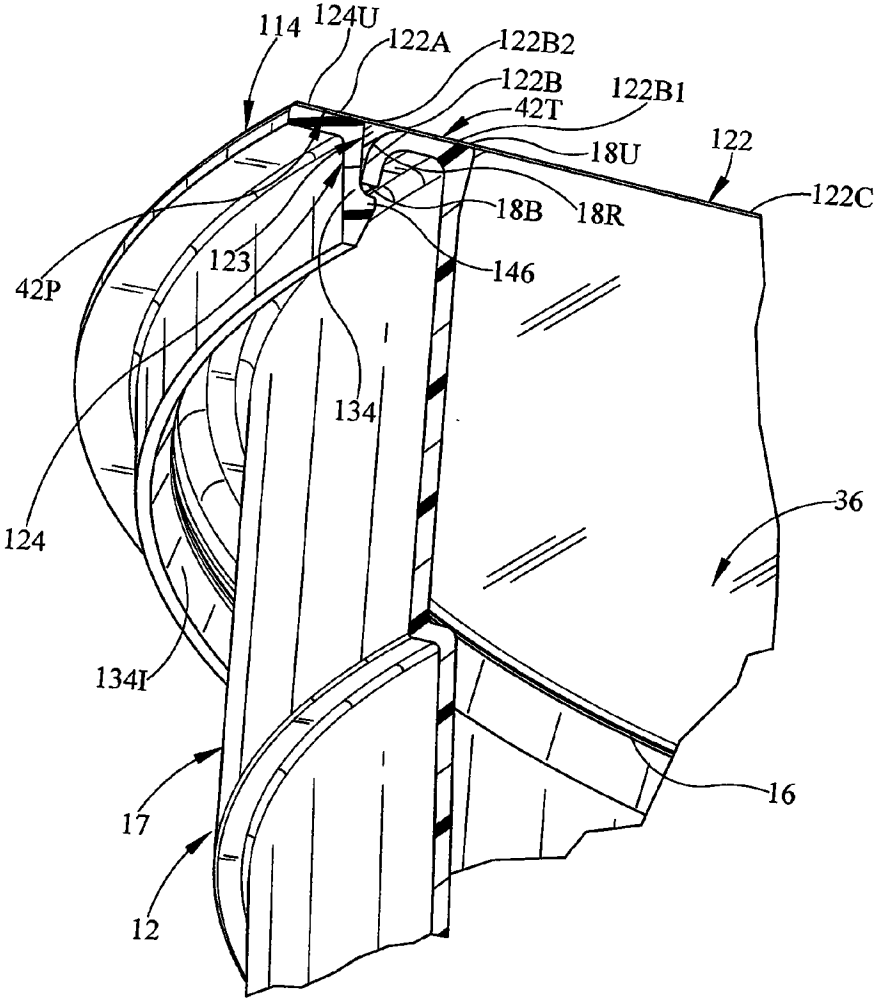
FIG. 17 is an enlarged perspective view of a section of the closure of FIGS. 12-16 after the closure is mounted on the container brim at a factory.

A first embodiment of a package 10 in accordance with the present disclosure is shown, for example, in FIGS. 1 and 5. Package 10 includes a container 12 and a closure 14 mounted on container 12 to close selectively an opening 16 formed in container 12 as suggested in FIG. 2. Closure 14 includes a sheet-support ring 24 and a membrane sheet 22. A process for coupling closure 14 to container 12 while wiping a mound of spilled food, when present, from a brim 18 of container 12 in radially inward and outward directions is shown, for example, in FIGS. 7-11. A second embodiment of a package 110 in accordance with the present disclosure is illustrated in FIGS. 12 and 16 and package 110 has a closure 114 including a sheet-support ring 124 and a membrane sheet 122. A third embodiment of a package 210 in accordance with the present disclosure is shown, for example, in FIGS. 18 and 22 and package 210 has a closure 214 including a sheet-support ring 224 and a membrane sheet 222.

Figures 18, 19, 20, 21:
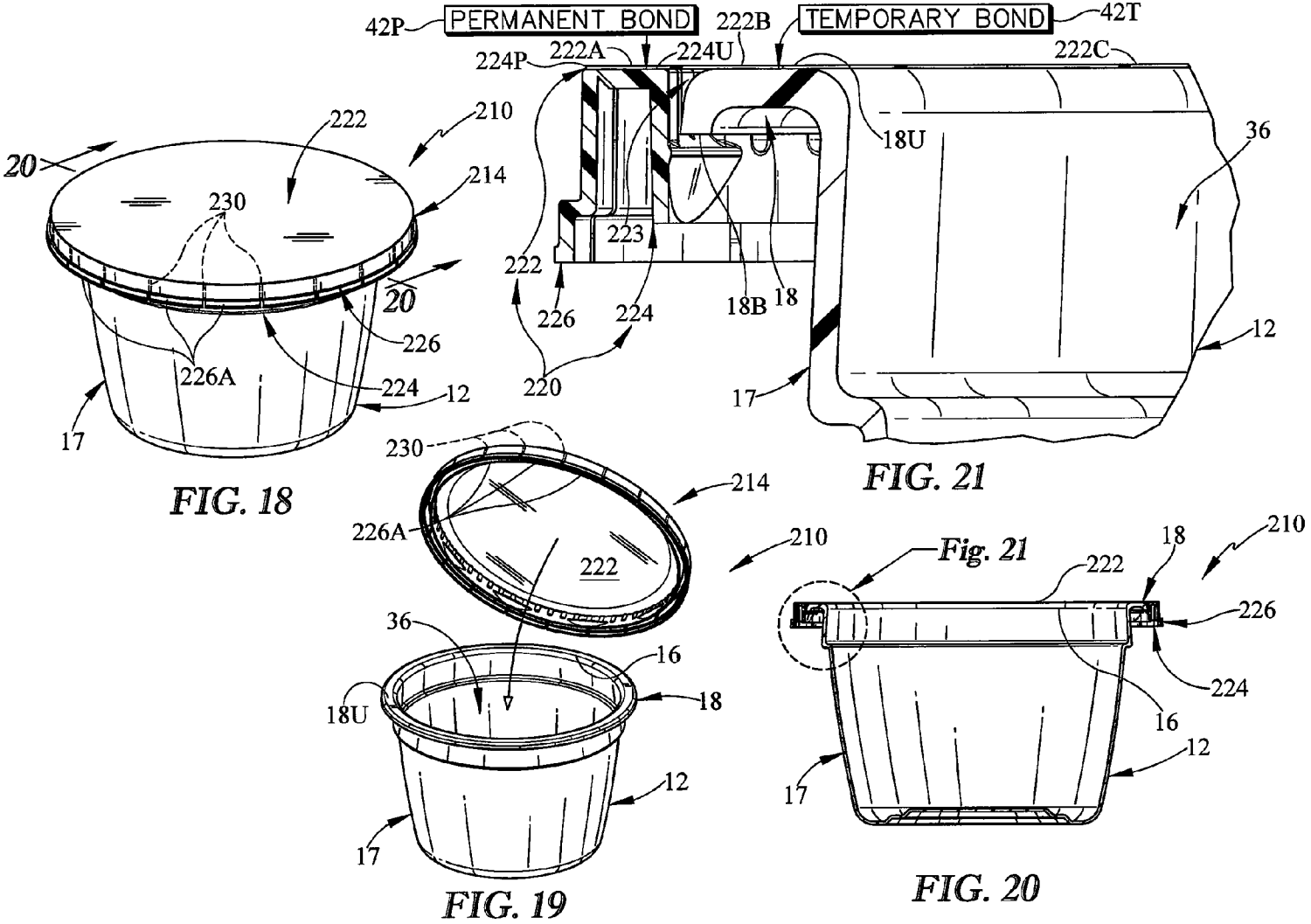
FIG. 18 is a perspective view of a third embodiment of a package in accordance with the present disclosure and showing that the package includes a container and a closure mounted on a brim of the container and made of a lid comprising a substantially flat membrane sheet that is shown in FIG. 21 to be bonded to an endless upwardly facing surface of a sheet-support ring arranged to surround the container brim and bonded temporarily to an endless upwardly facing top surface of the container brim to establish an endless hermetic seal therebetween at a container-filling factory.
FIG. 19 is a perspective view of the container of FIG. 18 before the closure is mated with the container brim to close an opening into an interior product-storage region formed in a bowl of the container.
FIG. 20 is a sectional view taken along line 20-20 of FIG. 18.
FIG. 21 is an enlarged partial sectional view taken from a circled region of FIG. 20 showing that the closure also includes an annular removable tamper band coupled to a perimeter edge of the sheet-support ring and that the sheet-support ring of the closure lid surrounds and mates with a radially outwardly facing side surface of the container brim and engages an axially downwardly facing bottom surface of the brim and showing that a substantially flat membrane sheet of the lid includes a central portion arranged to cover the opening into the interior product-storage region formed in the container bowl, an annular outer portion bonded permanently to an endless upwardly facing top surface of the sheet-support ring, and an annular middle portion bonded temporarily (using an adhesive, weld, or other suitable coupling means) to an endless upwardly facing top surface of the container brim to establish a hermetic seal therebetween until the closure is removed from the container brim by a consumer for a first time to access the contents of the interior product-storage region formed in the container bowl.

In each closure embodiment, a permanent bond 42P is established between a first portion of a membrane sheet 22, 122, and 222 and a companion sheet-support ring 24, 124, and 224 as suggested in FIGS. 4, 15, and 21. Also, a temporary bond 42T is established between a second portion of membrane sheet 22, 122, and 222 and a companion container brim 18, 118, and 218 as also suggested in FIGS. 4, 15, and 21 when closure 14, 114, and 214 is first mounted on a companion container brim 18, 118, and 218 at a container-filling factory.

Packages 10, 110, and 210 are configured to receive and store products such as, for example, food. Container 12 of each package 10, 110, 210 includes a bowl 17 that is formed to define interior product-storage region 36 and formed to include opening 16 that is arranged to open into interior product-storage region 36. Closures 14, 114, and 214 are configured to mount on container 12 to close opening 16 and selectively block access to interior product-storage region 36.

When food is discharged toward interior product-storage region 36 formed in container 12, for example, during a container filling step, some food may land on container brim 18. When one of closures 14, 114, 214, in accordance with the present disclosure, is mounted on container 12, the closure clears the food from brim 18 by wiping the food from brim 18 in radially inward and/or radially outward directions. Packages 10, 110, 210 are then heated to gasify remaining food on brim 18 and to create a temporary bond (and hermetic seal) between closures 14, 114, 214 and container 12 so that the food in interior product-storage region 36 is sealed in packages 10, 110, 210 until closures 14, 114, 214 are removed from container 12 for the first time by a consumer. Subsequent mounting of closures 14, 114, 214 on brim 18 causes access to interior product-storage region 36 to be blocked.

Package 10 includes container 12 comprising a bowl 17 and a brim 18 as shown, for example, in FIG. 2. Closure 14 is mounted on brim 18 of container 12 as suggested in FIGS. 1-4. For example, closure 14 comprises a substantially flat membrane sheet 22, a sheet-support ring 24, and an annular removable tamper band 26 as shown in FIGS. 2-4. Substantially flat membrane sheet 22 is bonded permanently by permanent bond 42P to an endless upwardly facing top surface 24U of sheet-support ring 24 as shown in FIG. 4. Membrane sheet 22 is bonded temporarily by temporary bond 42T to an upwardly facing top surface 18U of container brim 18 at a container-filling factory to establish an endless hermetic seal between closure 14 and container brim 18 as suggested in FIG. 4. Sheet-support ring 24 is arranged to surround brim 18 of container 12 when closure 14 is positioned to lie in the closed position on brim 18 and cooperate with membrane sheet 22 to form a lid 20.

Figure 6:
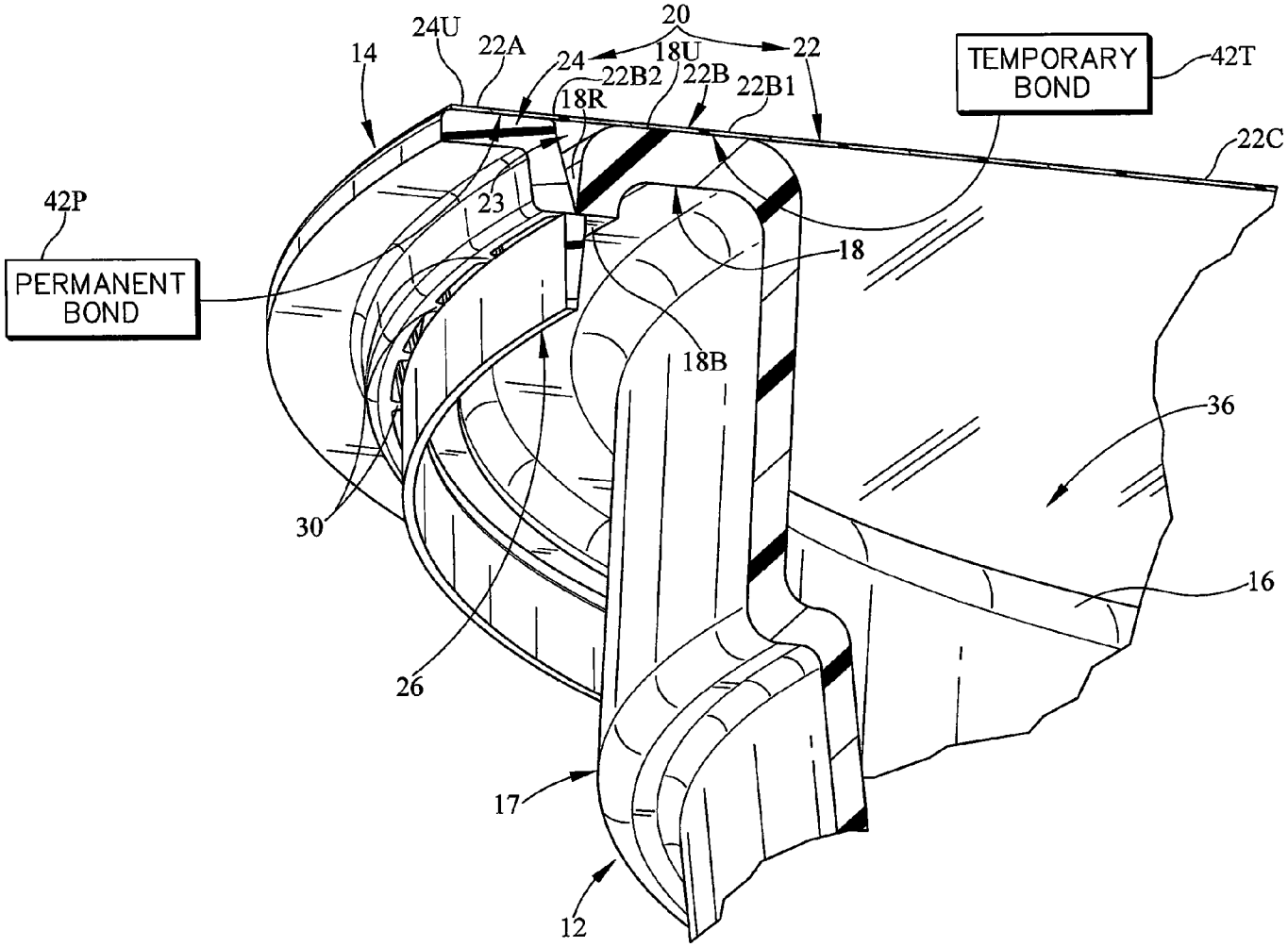
FIG. 6 is an enlarged perspective view of a section of the closure of FIGS. 1-5 after the closure is mounted on the container brim at a factory to mate the lid and the removable tamper band of the closure with the brim of the container and showing four of the circumferentially spaced-apart frangible connectors included in the closure and used initially to couple the removable tamper band to the sheet-support ring.

As shown, for example, in FIG. 4, sheet-support ring 24 of closure lid 20 surrounds and mates with a radially outwardly facing side surface 18R of brim 18 of container 12. Annular removable tamper band 26 is coupled initially by a series of frangible connectors 30 to sheet-support ring 24 of lid 20. Annular removable tamper band 26 is arranged to extend downwardly away from sheet-support ring 24 as shown in FIGS. 4 and 6. Annular removable tamper band 26 of closure 14 is coupled to an axially extending sleeve 34 of sheet-support ring 24 and is arranged to engage an axially downwardly facing bottom surface of brim 18.

Substantially flat membrane sheet 22 of closure lid 20 includes a central portion 22C, an annular middle portion 22B, and an annular outer portion 22A as shown in FIG. 4. Membrane sheet 22 is made of a thin elastic film in illustrative embodiments. Central portion 22C is arranged to cover an opening 16 that opens into an interior product-storage region 36 formed in container 12 as shown in FIG. 2. Annular outer portion 22A is bonded permanently to an endless upwardly facing top surface 24U of sheet-support ring 24. Annular middle portion 22B is bonded temporarily (using an adhesive, weld, or other suitable coupling means) to an upwardly facing top surface 18U of brim 18 to create a hermetic seal therebetween until closure 14 is removed from brim 18 by a consumer for a first time as suggested in FIG. 5 to access the contents of interior product-storage region 36 formed in bowl 17 of container 12. Endless upwardly facing top surface 24U of sheet-support ring 24 is arranged to lie in substantially coplanar relation with endless upwardly facing top surface 18U of brim 18 when closure 14 is positioned to lie in the closed position on brim 18 as suggested in FIG. 4.

A closure removal process 11 is shown, for example, in FIG. 5 in which a consumer removes closure 14 for the first time. Closure removal process 11 includes the step of (1) gripping a pull tab 38 coupled to a perimeter edge 40 of substantially flat membrane sheet 22 and lifting sheet-support ring 24 upwardly owing to a permanent bond 42P established between annular outer portion 22A of membrane sheet 22 and sheet-support ring 24. As a result, frangible connectors 30 that were coupled initially to each of sheet-support ring 24 and annular removable tamper band 26 break and allow separation of a first arc-shaped section 241 of sheet-support ring 24 from brim 18. As first arc-shaped section 241 separates from brim 18, temporary bond 42T (and the hermetic seal) that had been established between annular middle portion 22B of membrane sheet 22 of closure lid 20 and endless upwardly facing top surface 18U of container brim 18 is broken. First arc-shaped section 241 continues to move upwardly away from a companion first arc-shaped section 261 of annular removable tamper band 26.

Closure removal process 11 further includes the step of (2) completing separation of sheet-support ring 24 of closure lid 20 from brim 18 to break all temporary bonds 42T between annular middle portion 22B of membrane sheet 22 of closure lid 20 and endless upwardly facing top surface 18U of brim 18. Closure lid 20 may then be inverted while allowing annular removable tamper band 26 to fall downwardly and land on a surface 44 underneath container 12 to surround container 12 as shown in FIG. 5. Closure lid 20 includes, for example, sheet-support ring 24, substantially flat membrane sheet 22, and pull tab 38.

Sheet-support ring 24 includes axially extending sleeve 34 and circumferentially spaced-apart, radially inwardly extending, lid-retention ribs 46 as shown in FIGS. 5 and 5A. Circumferentially spaced-apart, radially inwardly extending, lid-retention ribs 46 are coupled to an inner surface 34I of axially extending sleeve 34 and configured to establish a somewhat tight interference fit between closure lid 20 and brim 18 to retain closure lid 20 in a stationary position on brim 18 each time a consumer mounts closure lid 20 shown in Step 2 of FIG. 5 once again on brim 18 of container 12.

Closure 14 is coupled to container brim 18 at a factory in such a way so that annular removable tamper band 26 remains coupled to closure lid 20 as suggested in FIG. 6. Annular removable tamper band 26 is coupled to closure lid 20 by several circumferentially spaced-apart frangible connectors 30. Specifically, four of the circumferentially spaced-apart frangible connectors 30 are shown in FIG. 6. Circumferentially spaced-apart frangible connectors 30 are used initially to couple annular removable tamper band 26 to sheet-support ring 24.

An inner perimeter edge of upwardly facing top surface 24U of sheet-support ring 24 of closure 14 is arranged to surround and lie in spaced-apart relation to an outer perimeter edge of upwardly facing top surface 18U of brim 18 of container 12 to form a ring-shaped space 23 therebetween as suggested in FIGS. 4 and 6. Ring-shaped middle portion 22B of membrane sheet 22 includes a ring-shaped anchor portion 22B1 coupled to the outer perimeter edge of central portion 22C. Ring-shaped anchor portion 22B1 is formed to include the downwardly facing surface confronting the bonding portion of upwardly facing top surface 18U of brim 18. Ring-shaped middle portion 22B is also formed to include a ring-shaped bridge portion 22B2 arranged to lie between and interconnect the inner perimeter edge of ring-shaped outer portion 22A and ring-shaped anchor portion 22B1. Ring-shaped bridge portion 22B2 is arranged to lie in an unsupported position over and across the ring-shaped space 23 provided between the upwardly facing top surfaces 24U, 18U of sheet-support ring 24 and brim 18.

Container brim 18 also includes an axially downwardly facing bottom surface 18B arranged to lie in spaced-apart relation to endless upwardly facing top surface 18U of brim 18 as suggested in FIGS. 4 and 6. A portion of closure 14 is arranged to lie under and in spaced-apart relation to ring-shaped bridge portion 22B1 of membrane sheet 22 to locate the ring-shaped space 23 therebetween and to extend in a radially inward direction toward interior product-storage region 36 to engage axially downwardly facing bottom surface 18B of brim 18 of container 10 when closure 14 is mounted on brim 18 in the closed position.

Closure 14 further includes a pull tab 38 coupled to ring-shaped outer portion 22A of membrane sheet 22 as shown in FIG. 1. Pull tab 38 is arranged to extend in a cantilevered manner away from sheet-support ring 24 of closure 14 and container brim 18 when closure 14 is mounted on brim 18 in the closed position to provide means for lifting sheet-support ring 24 upwardly to disengage brim 18 owing to the permanent bond 42P established between annular outer portion 22A of membrane sheet 22 and endless upwardly facing top surface 24U of sheet-support ring 24 to break the temporary bond 42T that had been established between annular middle portion 22B of membrane sheet 22 and upwardly facing top surface 18U of container brim 18 when closure is 14 is removed from container brim 18 for a first time to access any product stored in the interior product-storage region 36 formed in the bowl 17 of container 10. Pull tab 38 and membrane sheet 22 cooperate to form a monolithic element as suggested in FIGS. 1-6.

Package 10 is formed, for example, in a factory in a lidding process 13 as shown in FIGS. 7-11. During illustrative lidding process 13, closure 14 is moved downwardly relative to container brim 18 using a sealing head 48 and heater 50 to mount closure 14 on brim 18 of container 12. As a result, temporary bond 42T (and hermetic seal) is established between substantially flat membrane sheet 22 of closure lid 20 and endless upwardly facing top surface 18U of brim 18. At the same time, substantially flat membrane sheet 22 wipes a mound of spilled food 52, if present, from brim 18 during closure mounting. Finally, the lidding process 13 mates annular removable tamper band 26 and downwardly facing bottom surface 18B of container brim 18.

During illustrative lidding process 13, container 12 is located in an illustrative lidding unit 54 as shown FIG. 7. Closure 14 is arranged in a slightly raised position, as shown in FIG. 7, before closure 14 is mounted on brim 18 of container 12 at the factory. As sealing head 48 of lidding unit 54 moves downwardly, sealing head 48 engages closure 14 to cause closure 14 to assume an engaged position as shown in FIG. 8. When food is discharged toward interior product-storage region 36 formed in bowl 17 of container 12 during an earlier container filling step, some food may land on upwardly facing top surface 18U of container brim 18 and is now located between annular middle portion 22B of substantially flat membrane sheet 22 and underlying top surface 18U of container brim 18 at the site of temporary bond 42T that will be established using heat between membrane sheet 22 and container brim 18.

As sealing head 48 continues to move downwardly, closure 14 moves to a subsequent second engaged position on brim 18 as shown in FIG. 9. Mound of spilled food 52 is compressed between membrane sheet 22 of lid 20 and brim 18 of container 12 as a result of downward movement of closure 14 relative to container brim 18 to cause some of that food 521 to flow radially inwardly into interior product-storage region 36 formed in bowl 17 of container 12 and some of the food 52O to flow radially outwardly away from bowl 17 of container 12 as shown in FIG. 9.

Figures 10, 11:
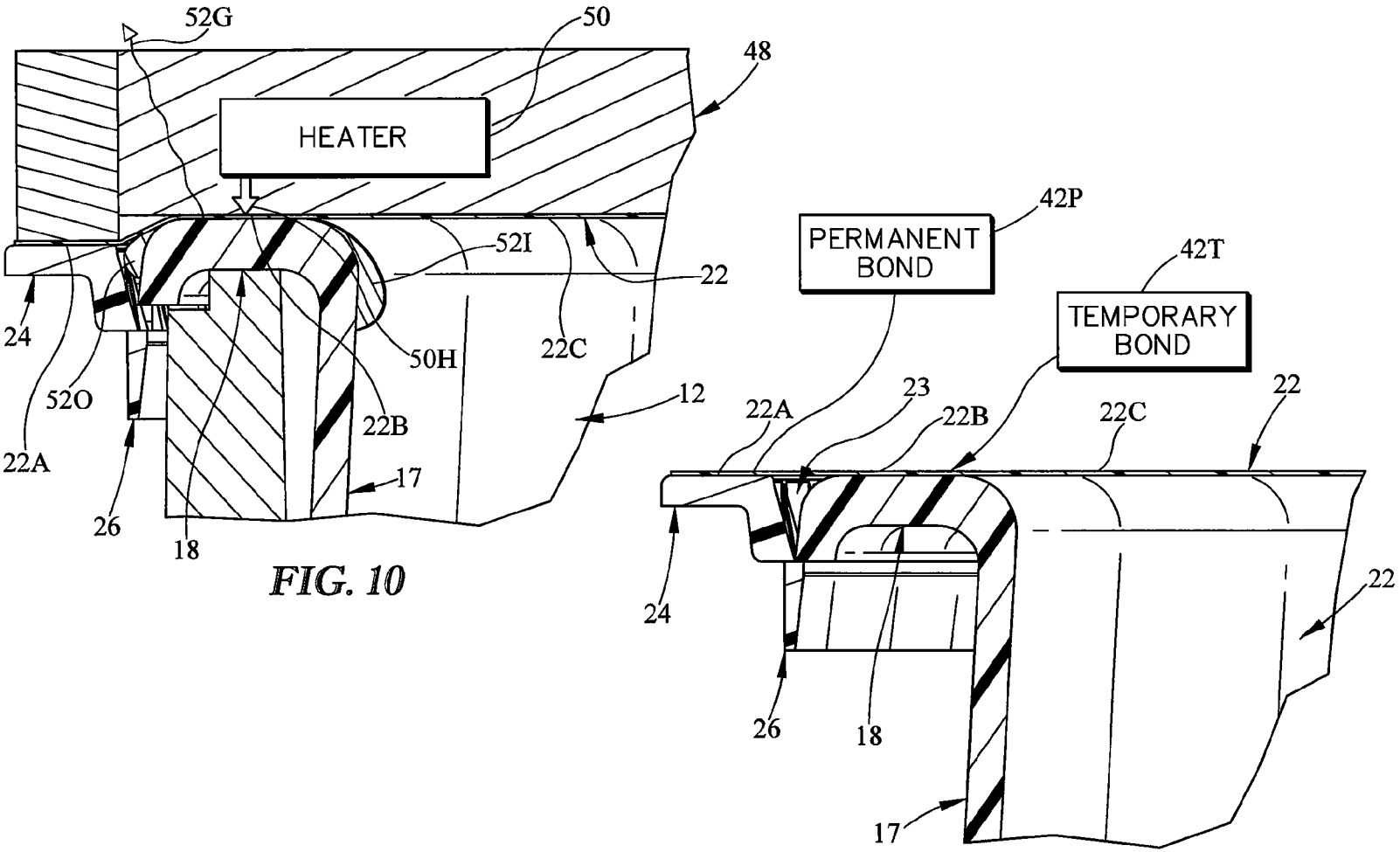

Continued downward movement of sealing head 48 causes closure 14 to move downward relative to container brim 18 substantially to clear spilled food 52 from upwardly facing top surface 18U of container brim 18 as shown in FIG. 10. Heater 50 included in sealing head 48 is then activated to provide heat 50H to annular middle portion 22B of substantially flat membrane sheet 22 to establish temporary chemical bond 42T (and hermetic sealed connection) between annular middle portion 22B of membrane sheet 22 and endless upwardly facing top surface 18U of container brim 18. At the same time heat 50H is applied, any minute quantity of residual spilled food left on upwardly facing top surface 18U of container brim 18 is gasified during exposure of membrane sheet 22 to heat 50H from heater 50 and is passed as a gas 52G through membrane sheet 22 to the surroundings as shown in FIG. 10. Once lidding process 13 is complete, sealing head 48 moves away from closure 14 as suggested in FIG. 11.

In the embodiment illustrated in FIGS. 1-11, package 10 includes a bowl 17 formed to include an interior product-storage region 36 and a brim coupled to an upper portion of bowl 17 and arranged to border an opening 16 into interior product-storage region 36 as suggested in FIG. 2. Brim 18 includes a radially outwardly facing side surface 18R arranged to surround the upper portion of bowl 17 and an endless upwardly facing top surface 18U arranged to lie between the upper portion of bowl 17 and radially outwardly facing side surface 18R.

Package 10 also includes a closure 14 configured to mount on brim 18 in a closed position to close the opening 16 and block access to interior product-storage region 36 formed in bowl 17 and to be removed by a consumer to gain access to interior product-storage region 36. Closure 14 includes a sheet-support ring 24 arranged to mate with brim 18 when closure 4 is positioned to lie in the closed position on brim 18. Sheet-support ring 24 includes an endless upwardly facing top surface 24U arranged to lie adjacent to a portion of the endless upwardly facing top surface 18U of brim 18 when closure 14 is positioned to lie in the closed position on brim 18 as suggested in FIG. 4. Closure 14 further includes a membrane sheet 22 coupled to sheet-support ring 24 to move therewith relative to brim 18 of container 12 when closure 14 is separated from brim 18 to gain access to interior product-storage region 36.

Membrane sheet 22 of closure 14 includes a ring-shaped outer portion 22A bonded permanently to sheet-support ring 24 to form an endless seal therebetween and, a central portion 22C surrounded by the ring-shaped outer portion 22A and arranged to cover the opening 16 into interior product-storage region 36 when closure 14 is positioned to lie in the closed position on brim 18 as suggested in FIGS. 4 and 6. Membrane sheet 22 also includes a ring-shaped middle portion 22B arranged to interconnect an outer perimeter edge of central portion 22C and an inner perimeter edge of the ring-shaped outer portion 22A as suggested in FIGS. 4 and 6. Ring-shaped middle portion 22B includes a downwardly facing surface arranged to overlie and confront a bonding portion of the endless upwardly facing top surface 18U of brim 18. As used herein, an element that is ring shaped, may have a circular or non-circular shape.

Package 10 further comprises means 42T for bonding the downwardly facing surface of the ring-shaped middle portion 22B of membrane sheet 22 temporarily to the bonding portion of the upwardly facing top surface 18U of brim 18 as suggested in FIGS. 4 and 6. Such bonding establishes an endless hermetic seal therebetween that remains until closure 14 is removed from brim 18 by a consumer for a first time to gain access to product stored in interior product-storage region 36 of bowl 17.

Sheet-support ring 24 is arranged to surround brim 18 of container 12 when closure 14 is positioned to lie in the closed position on brim 18 as suggested in FIGS. 1, 3, and 6. The endless upwardly facing top surface 24U of sheet-support ring 24 is arranged to lie in substantially coplanar relation with endless upwardly facing top surface 18U of brim 18 when closure 14 is positioned to lie in the closed position on brim 18. Membrane sheet 22 is substantially flat. Membrane sheet 22 is made of a thin elastic film. A ring-shaped space 23 is provided between the endless upwardly facing top surfaces 24U, 18U of sheet-support ring 24 and brim 18. Ring-shaped middle portion 22B of membrane sheet 22 is arranged to extend across ring-shaped space 23 as suggested in FIGS. 4 and 6.

An inner perimeter edge of the upwardly facing top surface 24U of sheet-support ring 24 of closure 14 is arranged to surround and lie in spaced-apart relation to an outer perimeter edge of the upwardly facing top surface 18U of brim 18 of container to form a ring-shaped space 23 therebetween as suggested in FIGS. 4 and 6. The ring-shaped middle portion 22B of membrane sheet 22 includes a ring-shaped anchor portion 22B1 that is coupled to the outer perimeter edge of central portion 22C and that is formed to include the downwardly facing surface confronting the bonding portion of the upwardly facing top surface 18U of brim 18. The ring-shaped middle portion 22B of membrane sheet 22 also includes a ring-shaped bridge portion 22B2 arranged to lie between and interconnect the inner perimeter edge of the ring-shaped outer portion 22A and the ring-shaped anchor portion 22B1 and to lie in an unsupported position over and across the ring-shaped space 23 provided between the upwardly facing top surfaces 24U, 18U of sheet-support ring 24 and brim 18.

Brim 18 of container 12 also includes an axially downwardly facing bottom surface 18B arranged to lie in spaced-apart relation to the endless upwardly facing top surface 18U of the brim 18 as suggested in FIGS. 4 and 6. A portion of closure 14 is arranged to lie under and in spaced-apart relation to the ring-shaped bridge portion 22B2 of membrane sheet 22 to locate ring-shaped space 23 therebetween and to extend in a radially inward direction toward interior product-storage region 36 to engage the axially downwardly facing bottom surface 18B of brim 18 of container 12 when closure 14 is mounted on brim 18 in the closed position as suggested in FIGS. 4 and 6.

Closure 14 further includes a pull tab 38 coupled to the ring-shaped outer portion 22A of membrane sheet 22 and arranged to extend in a cantilevered manner away from sheet-support ring 24 of closure 14 and brim 18 of container 12 when closure 14 is mounted on brim 18 in the closed position as suggested in FIG. 1. Pull tab 38 is configured to provide means for lifting sheet-support ring 24 upwardly to disengage brim 18 owing to the permanent bond 42P established between the annular outer portion 22A of membrane sheet 22 and the endless upwardly facing top surface 24U of sheet-support ring 24 to break the temporary bond 42T that had been established between the annular middle portion 22B of membrane sheet 22 and the upwardly facing top surface 18U of brim 18 of container 12 when closure 14 is removed from brim 18 of container 12 for a first time to access any product stored in interior product-storage region 36 formed in bowl 17 of container 12. Pull tab 38 and the membrane sheet 22 cooperate to form a monolithic element as suggested in FIG. 1.

Another embodiment of a package 110 in accordance with the present disclosure is shown, for example in FIGS. 12-16. Package 110 includes container 12 and closure 114 mounted on brim 18 of container 12. For example, closure 114 is made of a closure lid 120 comprising a substantially flat membrane sheet 122 and a sheet-support ring 124 as shown in FIGS. 13-15. Membrane sheet 122 is made of a thin elastic film in illustrative embodiments. Substantially flat membrane sheet 122 is bonded permanently to an endless upwardly facing top surface 124U of sheet-support ring 124 as shown in FIG. 15. Sheet-support ring 124 is arranged to surround brim 18 of container 12 to define a ring-shaped space 123 therebetween when closure 14 is positioned to lie in the closed position on brim 18.

Sheet-support ring 124 surrounds and mates with a radially outwardly facing side surface 18R container brim 18 and engages an axially downwardly facing bottom surface 18B of brim 18. Substantially flat membrane sheet 122 includes a central portion 122C, an annular outer portion 122A, and an annular middle portion 122B including a ring-shaped anchor portion 122B1 and a ring-shaped bridge portion 122B2. Central portion 122C is arranged to cover opening 16 arranged to open into interior product-storage region 36 formed in bowl 17 of container 12 as shown in FIG. 15. Annular outer portion 122A is bonded permanently to an endless upwardly facing top surface 124U of sheet-support ring 124. Annular middle portion 122B is bonded temporarily (using an adhesive, weld, or other suitable coupling means) to an endless upwardly facing top surface 18U of container brim 18 to establish a hermetic seal therebetween until closure 114 is removed from container brim 18 by a consumer for a first time to access the contents of interior product-storage region 36 formed in bowl 17 of container 12. Endless upwardly facing top surface 124U of sheet-support ring 124 is arranged to lie in substantially coplanar relation with endless upwardly facing top surface 18U of brim 18 to locate ring-shaped space 123 therebetween when closure 114 is positioned to lie in the closed position on brim 18 as suggested in FIG. 15.

Figure 23:
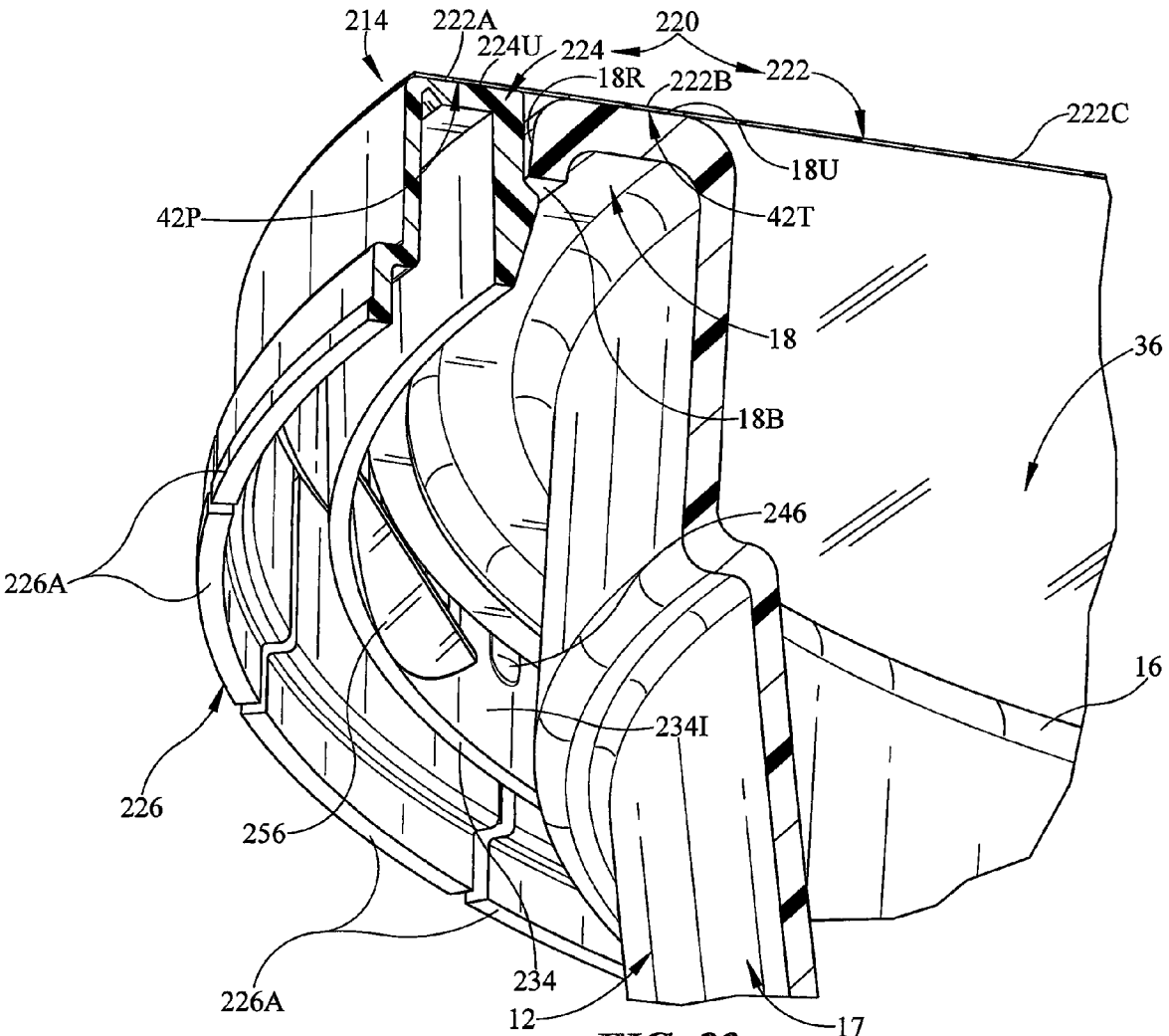
FIG. 23 is an enlarged perspective view of a section of the closure of FIGS. 18-22 after the closure is mounted on the container brim at a factory.

An inner perimeter edge of upwardly facing top surface 124U of sheet-support ring 124 of closure 114 is arranged to surround and lie in spaced-apart relation to an outer perimeter edge of upwardly facing top surface 18U of container brim 18 to form a ring-shaped space 123 therebetween as suggested in FIGS. 15 and 23. Ring-shaped middle portion 122B of membrane sheet 122 includes a ring-shaped anchor portion 122B1 coupled to the outer perimeter edge of central portion 122C. Ring-shaped anchor portion 122B1 is formed to include the downwardly facing surface confronting the bonding portion of upwardly facing top surface 18U of brim 18. Ring-shaped middle portion 122B is also formed to include a ring-shaped bridge portion 122B2 arranged to lie between and interconnect the inner perimeter edge of ring-shaped outer portion 122C and ring-shaped anchor portion 122B1. Ring-shaped bridge portion 122B2 is arranged to lie in an unsupported position over and across the ring-shaped space 123 provided between the upwardly facing top surfaces 124U, 18U of sheet-support ring 124 and brim 18.

Container brim 18 also includes an axially downwardly facing bottom surface 18B arranged to lie in spaced-apart relation to endless upwardly facing top surface 18U of brim 18. A portion of closure 14 is arranged to lie under and in spaced-apart relation to ring-shaped bridge portion 122B2 of membrane sheet 122 to locate ring-shaped space 123 therebetween and to extend in a radially inward direction toward interior product-storage region 36 to engage axially downwardly facing bottom surface 18B of container brim 18 when closure 14 is mounted on brim 18 in the closed position.

A closure removal process 111 is shown, for example, in FIG. 16 in which a consumer removes closure 114 for the first time. Closure removal process 111 includes the step of (1) gripping a pull tab 138 coupled to a perimeter edge 140 of substantially flat membrane sheet 122 and lifting sheet-support ring 124 upwardly owing to a permanent bond 42P established between annular outer portion 122A of membrane sheet 122 and sheet-support ring 124 to allow separation of a first arc-shaped section 1241 of sheet-support ring 124 from brim 18. As first arc-shaped section 1241 separates from brim 18, a temporary bond 42T (and hermetic seal) that had been established between annular middle portion 124B of membrane sheet 122 of closure lid 120 and endless upwardly facing top surface 18U of container brim 118 is broken.

Closure removal process 111 further includes the step of (2) completing separation of sheet-support ring 124 of closure lid 120 from brim 18 to break all temporary bonds 42T between annular middle portion 122B of membrane sheet 122 of closure lid 120 and endless upwardly facing top surface 18U of brim 18. Closure lid 120 may then be inverted and placed on a surface 44 adjacent container 12.

Sheet-support ring 124 includes axially extending sleeve 134 and a radially inwardly extending brim retainer 146 as shown in FIGS. 16 and 16A. Radially inwardly extending brim retainer 146 is coupled to an inner surface 1341 of axially extending sleeve 134 and configured to establish a somewhat tight interference fit between closure lid 120 and container brim 18 to retain closure lid 120 in a stationary position on container brim 18 each time a consumer mounts closure lid 120 as shown in Step 2 of FIG. 16 once again on brim 18 of container 12.

Closure 114 includes a pull tab 138 coupled to the ring-shaped outer portion 122A of membrane sheet 22 as suggested in FIGS. 12 and 15. Pull tab 138 is arranged to extend in a cantilevered manner away from sheet-support ring 124 of closure 114 and brim 18 of container 12 when closure 114 is mounted on brim 18 in the closed position to provide means for lifting sheet-support ring 124 upwardly to disengage brim 18 owing to the permanent bond 42P established between the annular outer portion 122A of membrane sheet 122 and the endless upwardly facing top surface 124U of sheet-support ring 124 to break the temporary bond 42T that had been established between the annular middle portion 122B of membrane sheet 122 and the upwardly facing top surface 18U of brim 18 of container 12 when closure 114 is removed from brim 18 of container 12 for a first time to access any product stored in interior product-storage region 36 formed in bowl 17 of container 12. Pull tab 138 and membrane sheet 122 cooperate to form a monolithic element as suggested in FIG. 12.

Another embodiment of a package 210 in accordance with the present disclosure is shown in FIGS. 18-21. Package 210 includes container 12 and a closure 214 mounted on brim 18 of container 12. For example, closure 214 is made of a closure lid 220 comprising a substantially flat membrane sheet 222, a sheet-support ring 224, and an annular removable tamper band 226 as shown in FIGS. 18-21. Membrane sheet 222 is made of a thin elastic material in illustrative embodiments. Substantially flat membrane sheet 222 is bonded permanently to an endless upwardly facing top surface 224U of sheet-support ring 224 as shown in FIG. 21. Sheet-support ring 224 is arranged to surround brim 18 of container 12 to define a ring-shaped space 223 therebetween when closure 14 is positioned to lie on brim 18. Annular removable tamper band 226 is coupled to a perimeter edge 224P of sheet-support ring 224.

As shown, for example, in FIG. 21, sheet-support ring 224 of closure lid 220 surrounds and mates with a radially outwardly facing side surface 18R of brim 18 of container 12 and engages an axially downwardly facing bottom surface 18B of brim 18. Substantially flat membrane sheet 222 of closure lid 220 includes a central portion 222C, an annular middle portion 222B including a ring-shaped anchor portion 222B1 and a ring-shaped bridge portion 222B2, and an annular outer portion 222A as shown in FIG. 21. Central portion 222C is arranged to cover opening 16 that opens into an interior product-storage region 36 formed in bowl 17 of container 12 as shown in FIG. 19. Annular outer portion 222A is bonded permanently to endless upwardly facing top surface 224U of sheet-support ring 224. Annular middle portion 222B is bonded temporarily, using an adhesive, weld, or other suitable coupling means, to an endless upwardly facing top surface 18U of brim 18 to establish a hermetic seal until closure 214 is removed from brim 218 by a consumer for a first time as suggested in FIG. 22 to access the contents of interior product-storage region 36 formed in bowl 17 of container 12. Endless upwardly facing top surface 224U of sheet-support ring 224 is arranged to lie in substantially coplanar relation with endless upwardly facing top surface 18U of brim 18 when closure 214 is positioned to lie in the closed position on brim 18 as suggested in FIG. 21.

An inner perimeter edge of the upwardly facing top surface 224U of sheet-support ring 224 of closure 214 is arranged to surround and lie in spaced-apart relation to an outer perimeter edge of upwardly facing top surface 18U of container brim 18 to form a ring-shaped space 223 therebetween as suggested in FIGS. 21 and 23. Ring-shaped middle portion 222B of membrane sheet 222 includes a ring-shaped anchor portion 222B1 coupled to the outer perimeter edge of central portion 222C. Ring-shaped anchor portion 222B1 is formed to include the downwardly facing surface confronting the bonding portion of upwardly facing top surface 18U of brim 18. Ring-shaped middle portion 222B is also formed to include a ring-shaped bridge portion 222B2 arranged to lie between and interconnect the inner perimeter edge of ring-shaped outer portion 222A and ring-shaped anchor portion 222B1. Ring-shaped bridge portion 222B2 is arranged to lie in an unsupported position over and across ring-shaped space 223 provided between upwardly facing top surfaces 224U, 18U of sheet-support ring 224 and brim 18.

Container brim 18 also includes an axially downwardly facing bottom surface 18B arranged to lie in spaced-apart relation to endless upwardly facing top surface 18U of brim 18 and a portion of closure 214 is arranged to lie under and in spaced-apart relation to ring-shaped bridge portion 222B2 of membrane sheet 222 to locate ring-shaped space 223 therebetween and to extend in a radially inward direction toward interior product-storage region 36 to engage the axially downwardly facing bottom surface 18B of container brim 18 when closure 214 is mounted on brim 18 in the closed position.

Figure 22:
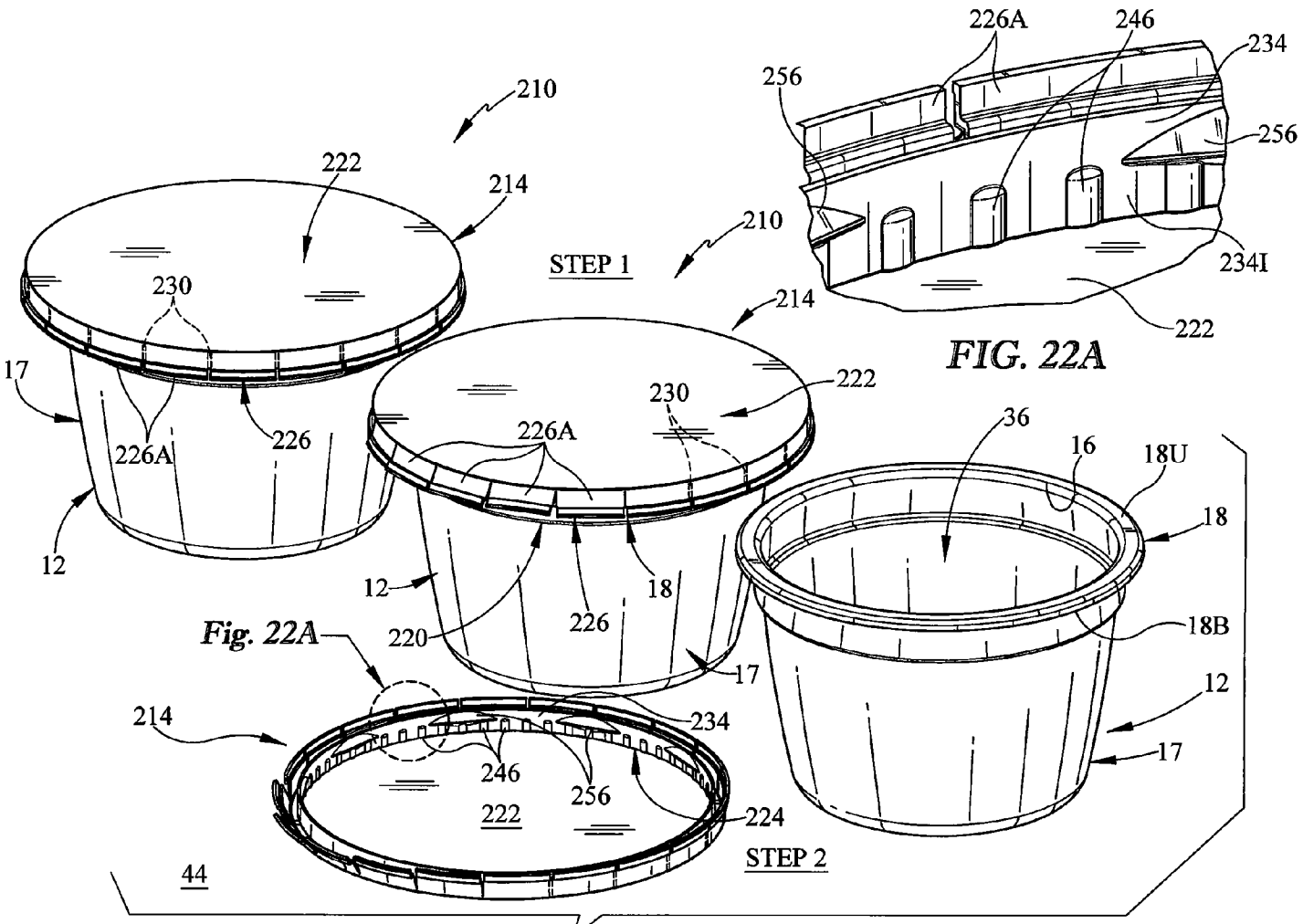
FIG. 22 shows an illustrative closure removal process in which a consumer removes the closure from the container brim for a first time and suggesting that the process includes the steps of: (1) gripping a portion of the annular removable tamper band coupled to a perimeter edge of the sheet-support ring and lifting the annular removable tamper band and sheet-support ring upwardly to cause breakage of frangible web connectors that were coupled initially to each of the pairs of adjacent tamper-band segments that comprise the annular removable tamper band and to allow separation of a first arc-shaped section of the sheet-support ring from the container brim to break the temporary bond (and hermetic seal) that had been established between the annular middle portion of the membrane sheet of the closure lid and the endless upwardly facing top surface of the container brim and move upwardly away from a companion first arc-shaped section of the annular removable tamper band and (2) completing separation of the sheet-support ring of the closure lid from the container brim to break all temporary bonds between the annular middle portion of the membrane sheet of the closure lid and the endless upwardly facing top surface of the container brim and then inverting the closure lid comprising the sheet-support ring, substantially flat membrane sheet, and tamper-band segments.

A closure removal process 211 is shown, for example, in FIG. 22 in which a consumer removes closure 214 for the first time. Closure removal process 211 includes the step of (1) gripping a portion of annular removable tamper band 226 coupled to perimeter edge 224P of sheet-support ring 224 and lifting annular removable tamper band 226 and sheet-support ring 224 upwardly to cause breakage of frangible web connectors 230 that were coupled initially to each of the pairs of adjacent segments 226A that comprise annular removable tamper band 226 to allow separation of a first arc-shaped section 2241 of sheet-support ring 224 from brim 18. As first arc-shaped section 2241 separates from brim 18, temporary bond 42T (and hermetic seal) that had been established between annular middle portion 224B of membrane sheet 222 of closure lid 220 and endless upwardly facing top surface 18U of container brim 18 is broken.

Closure removal process 211 further includes the step of (2) completing separation of sheet-support ring 224 of lid 220 from brim 18 to break all temporary bonds 42T between annular middle portion 222B of membrane sheet 222 of closure lid 220 and endless upwardly facing top surface 18U of brim 18. Closure lid 220 may then be inverted and arranged to lie on a surface 44 adjacent container 12. Closure lid 220 comprises sheet-support ring 224, substantially flat membrane sheet 222, and tamper-band segments 226A.

Sheet-support ring 224 includes axially extending sleeve 234, circumferentially spaced-apart, radially inwardly extending, lid-retention ribs 246, and circumferentially spaced-apart, radially inwardly extending, lid-retention bands 256 as shown in FIGS. 22 and 22A. Circumferentially spaced-apart, radially inwardly extending, lid-retention ribs 246 are coupled to an inner surface 234I of axially extending sleeve 234. Circumferentially spaced-apart, radially inwardly extending, lid-retention bands 256 are coupled to an inner surface 2341 of axially extending sleeve 234. Lid-retention bands 256 and lid-retention ribs 246 are configured to establish a somewhat tight interference fit between closure lid 220 and brim 18 to retain closure lid 220 in a stationary position on brim 18 each time a consumer mounts closure lid 220 shown in Step 2 of FIG. 22 once again on brim 18 of container 12.

Figure 24:
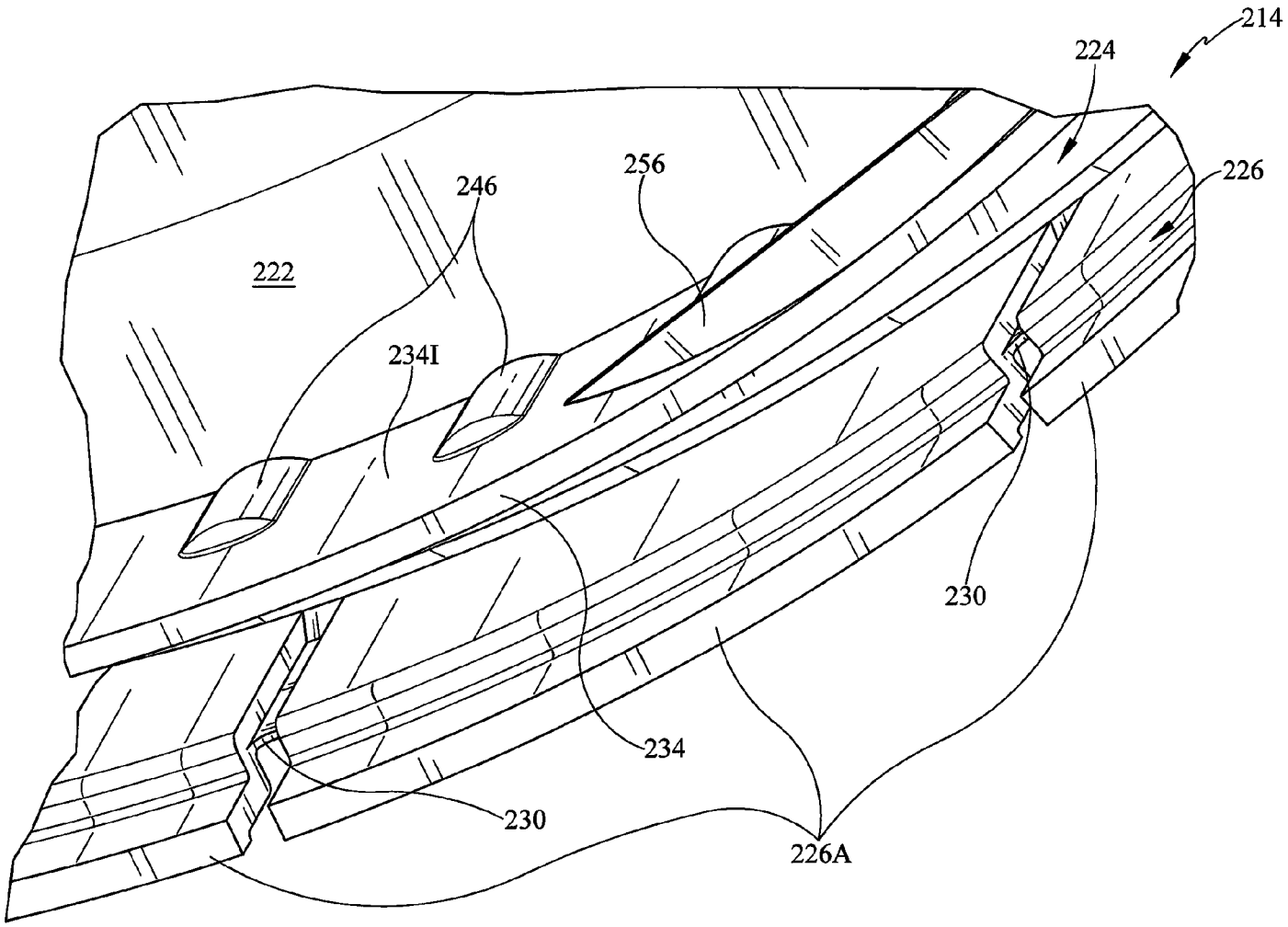
FIG. 24 is a view similar to FIG. 23 taken from another perspective showing that each pair of adjacent tamper-band segments included in the annular removable tamper band are coupled together by a frangible web connector.

Closure 214 is coupled to brim 18 at a factory in such a way so that annular removable tamper band 226 remains coupled to closure lid 220 so that all tamper-band segments 226A remain in a substantially vertical orientation as shown in FIG. 23. As suggested in FIG. 23 and shown in FIG. 24, each pair of adjacent tamper-band segments 226A is coupled together by a frangible web connector 230. One or more frangible web connectors 230 may be broken during removal of closure 214 from container 212. As a result, those tamper-band segments 226A remain in an angled orientation as suggested in FIG. 22 providing a visual indicator to consumers that someone has attempted to open package 210.

The invention claimed is:

1. A package comprising a container including a bowl formed to include an interior product-storage region and a brim coupled to an upper portion of the bowl and arranged to border an opening into the interior product-storage region, the brim including a radially outwardly facing side surface arranged to surround the upper portion of the bowl and an endless upwardly facing top surface arranged to lie between the upper portion of the bowl and the radially outwardly facing side surface, and a closure configured to mount on the brim in a closed position to close the opening and block access to the interior product-storage region formed in the bowl and to be removed by a consumer to gain access to the interior product-storage region, the closure including a sheet-support ring arranged to mate with the brim when the closure is positioned to lie in the closed position on the brim, the sheet-support ring including an endless upwardly facing top surface arranged to lie adjacent to a portion of the endless upwardly facing top surface of the brim when the closure is positioned to lie in the closed position on the brim, and the closure further including a membrane sheet coupled to the sheet-support ring to move therewith relative to the brim of the container when the closure is separated from the brim to gain access to the interior product-storage region, wherein the membrane sheet includes a ring-shaped outer portion bonded permanently to the sheet-support ring to form an endless seal therebetween, a central portion surrounded by the ring-shaped outer portion and arranged to cover the opening into the interior product-storage region when the closure is positioned to lie in the closed position on the brim, and a ring-shaped middle portion arranged to interconnect an outer perimeter edge of the central portion and an inner perimeter edge of the ring-shaped outer portion, the ring-shaped middle portion includes a downwardly facing surface arranged to overlie and confront a bonding portion of the endless upwardly facing top surface of the brim, and the package further comprises means for bonding the downwardly facing surface of the ring-shaped middle portion of the membrane sheet temporarily to the bonding portion of the upwardly facing top surface of the brim to establish an endless hermetic seal therebetween that remains until the closure is removed from the brim by a consumer for a first time to gain access to product stored in the interior product-storage region, wherein the endless upwardly facing top surface of the sheet-support ring is arranged to lie in coplanar relation with the endless upwardly facing top surface of the brim when the closure is positioned to lie in the closed position on the brim.

2. The package of claim 1, wherein the sheet-support ring is arranged to surround the brim of the container when the closure is positioned to lie in the closed position on the brim.

3. The package of claim 2, wherein the membrane sheet is flat.

4. The package of claim 2, wherein the membrane sheet is made of a thin elastic film.

5. The package of claim 1, wherein the membrane sheet is flat.

6. The package of claim 1, wherein the membrane sheet is made of a thin elastic film.

7. The package of claim 1, wherein a ring-shaped space is provided between the endless upwardly facing top surfaces of the sheet-support ring and the brim and the ring-shaped middle portion of the membrane sheet is arranged to extend across the ring-shaped space.

8. The package of claim 1, wherein an inner perimeter edge of the upwardly facing top surface of the sheet-support ring of the closure is arranged to surround and lie in spaced-apart relation to an outer perimeter edge of the upwardly facing top surface of the brim of the container to form a ring-shaped space therebetween and the ring-shaped middle portion of the membrane sheet includes a ring-shaped anchor portion coupled to the outer perimeter edge of the central portion and formed to include the downwardly facing surface confronting the bonding portion of the upwardly facing top surface of the brim and a ring-shaped bridge portion arranged to lie between and interconnect the inner perimeter edge of the ring-shaped outer portion and the ring-shaped anchor portion and to lie in an unsupported position over and across the ring-shaped space provided between the upwardly facing top surfaces of the sheet-support ring and the brim.

9. The package of claim 8, wherein the brim of the container also includes an axially downwardly facing bottom surface arranged to lie in spaced-apart relation to the endless upwardly facing top surface of the brim and a portion of the closure is arranged to lie under and in spaced-apart relation to the ring-shaped bridge portion of the membrane sheet to locate the ring-shaped space therebetween and to extend in a radially inward direction toward the interior product-storage region to engage the axially downwardly facing bottom surface of the brim of the container when the closure is mounted on the brim in the closed position.

10. The package of claim 1, wherein the closure further includes a pull tab coupled to the ring-shaped outer portion of the membrane sheet and arranged to extend in a cantilevered manner away from the sheet-support ring of the closure and the brim of the container when the closure is mounted on the brim in the closed position to provide means for lifting the sheet-support ring upwardly to disengage the brim owing to the permanent bond established between the annular outer portion of the membrane sheet and the endless upwardly facing top surface of the sheet-support ring to break the temporary bond that had been established between the annular middle portion of the membrane sheet and the upwardly facing top surface of the brim of the container when the closure is removed from the brim of the container for a first time to access any product stored in the interior product-storage region formed in the bond of the container.

11. The package of claim 10, wherein the pull tab and the membrane sheet cooperate to form a monolithic element.

* * * * *